US006757515B2

(12) United States Patent
Ueda

(10) Patent No.: US 6,757,515 B2
(45) Date of Patent: Jun. 29, 2004

(54) METHOD AND APPARATUS FOR IMAGE FORMING CAPABLE OF PERFORMING A STABLE SHEET TRANSFER OPERATION

(75) Inventor: Kenji Ueda, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 72 days.

(21) Appl. No.: 10/101,994

(22) Filed: Mar. 21, 2002

(65) Prior Publication Data

US 2002/0136576 A1 Sep. 26, 2002

(30) Foreign Application Priority Data

Mar. 21, 2001 (JP) ..... 2001-081211
Mar. 6, 2002 (JP) ..... 2002-060796

(51) Int. Cl.[7] ..... G03G 15/00; G03G 15/16
(52) U.S. Cl. ..... 399/396; 399/66
(58) Field of Search ..... 399/66, 388, 396

(56) References Cited

U.S. PATENT DOCUMENTS

| | | | | |
|---|---|---|---|---|
| 4,647,961 A | | 3/1987 | Kammoto et al. | |
| 4,841,358 A | | 6/1989 | Kammoto et al. | |
| 4,954,849 A | | 9/1990 | Koike et al. | |
| 4,968,997 A | | 11/1990 | Saitoh et al. | |
| 4,975,749 A | | 12/1990 | Tsunoda et al. | |
| 4,979,727 A | | 12/1990 | Koike et al. | |
| 5,014,091 A | | 5/1991 | Koike et al. | |
| 5,043,771 A | * | 8/1991 | Shibata et al. | 399/396 |
| 5,194,959 A | | 3/1993 | Kaneko et al. | |
| 5,404,206 A | | 4/1995 | Andoh et al. | |
| 5,471,290 A | | 11/1995 | Nagayama et al. | |
| 5,983,066 A | * | 11/1999 | Abe et al. | 399/396 X |
| 6,122,468 A | | 9/2000 | Sakamoto et al. | |
| 6,157,797 A | | 12/2000 | Saito et al. | |
| 6,215,974 B1 | | 4/2001 | Katoh et al. | |
| 6,249,304 B1 | | 6/2001 | Sawayama et al. | |
| 6,256,461 B1 | | 7/2001 | Takeyama et al. | |
| 6,292,641 B1 | | 9/2001 | Takeyama et al. | |
| 6,308,027 B1 | | 10/2001 | Obu et al. | 399/110 |
| 6,334,044 B1 | * | 12/2001 | Wasai et al. | 399/396 X |
| 6,397,035 B2 | * | 5/2002 | Kataoka et al. | 399/396 X |
| 6,529,703 B2 | * | 3/2003 | Kawasumi et al. | 399/396 X |

FOREIGN PATENT DOCUMENTS

| | | |
|---|---|---|
| EP | 0 992 860 | 4/2000 |
| EP | 0 997 788 | 5/2000 |
| JP | 9-249333 | 9/1997 |
| JP | 11-59954 | 3/1999 |
| JP | 11-59965 | 3/1999 |
| JP | 2001-206583 | 7/2001 |

OTHER PUBLICATIONS

Patent Abstracts of Japan, JP 5–289453, Nov. 5, 1993.

* cited by examiner

*Primary Examiner*—Fred L Braun
(74) *Attorney, Agent, or Firm*—Oblon, Spivak, McClelland, Maier & Neustadt, P.C.

(57) ABSTRACT

A sheet transferring apparatus for use in an image forming apparatus including a sheet transferring mechanism and a controller. The sheet transferring mechanism transfers a recording sheet at a transfer speed to an image forming mechanism in the image forming apparatus. The controller determines the transfer speed based on a transfer speed used for an immediately previous recording sheet.

19 Claims, 17 Drawing Sheets

Fig. 3A
(PRIOR ART)

| AA | BB | CC | DD | | | | EE | | |
|---|---|---|---|---|---|---|---|---|---|
| | | | DD1 | | DD2 | | EE1 | EE2 | EE3 |
| | | | MIN | MAX | MIN | MAX | | | |
| A—B | 28.0 | 28.0 | 3 | 4 | 5 | 6 | 24 | 0.1 | 0.42 |
| B—E | 95.4 | 123.4 | 5 | 7 | 9 | 11 | 24 | 0.2 | 0.83 |
| E—F | 10.0 | 133.4 | 2 | 3 | 3 | 4 | 25 | 0.1 | 0.40 |
| F—H | 98.5 | 231.9 | 4 | 5 | 6 | 7 | 25 | 0.1 | 0.40 |
| H—I | 12.1 | 244.0 | 4 | 5 | 6 | 7 | 25 | 0.1 | 0.40 |
| I—J | 100.0 | 344.0 | 0 | 0 | 0 | 0 | 25 | 0.1 | 0.40 |
| J—K | 15.0 | 359.0 | 0 | 0 | 0 | 0 | 25 | 0.1 | 0.40 |
| K—L | 100.0 | 459.0 | 0 | 0 | 0 | 0 | 20 | 0.03 | 0.15 |

Fig. 3B
(PRIOR ART)

| AA | FF | | | | GG | | | |
|---|---|---|---|---|---|---|---|---|
| | FF1 | | FF2 | | GG1 | | GG2 | |
| | MIN | MAX | MIN | MAX | MIN | MAX | MIN | MAX |
| A—B | 3.0 | 4.0 | 5.4 | 6.4 | 388.0 | 384.0 | 378.4 | 374.4 |
| B—E | 5.0 | 7.0 | 9.8 | 11.7 | 380.0 | 372.0 | 361.0 | 353.0 |
| E—F | 2.0 | 3.0 | 3.4 | 4.4 | 392.0 | 388.0 | 386.4 | 382.5 |
| F—H | 4.0 | 5.0 | 6.4 | 7.4 | 384.0 | 380.0 | 374.5 | 370.5 |
| H—I | 4.0 | 5.0 | 6.4 | 7.4 | 384.0 | 380.0 | 374.5 | 370.5 |
| I—J | 0.0 | 0.0 | 0.4 | 0.4 | 400.0 | 400.0 | 398.4 | 398.4 |
| J—K | 0.0 | 0.0 | 0.4 | 0.4 | 400.0 | 400.0 | 398.4 | 398.4 |
| K—L | 0.0 | 0.0 | 0.1 | 0.1 | 400.0 | 400.0 | 399.4 | 399.4 |

Fig. 8A

| AA | BB | CC | DD | | | | EE | | | FF | | | |
|---|---|---|---|---|---|---|---|---|---|---|---|---|---|
| | | | DD1 | | DD2 | | EE1 | EE2 | EE3 | FF1 | | FF2 | |
| | | | MIN | MAX | MIN | MAX | | | | MIN | MAX | MIN | MAX |
| A−B | 28.0 | 28.0 | 3 | 4 | 5 | 6 | 24 | 0.1 | 0.42 | 3.0 | 4.0 | 5.4 | 6.4 |
| B−C | 10.0 | 38.0 | 5 | 7 | 8 | 11 | 24 | 0.2 | 0.83 | 5.0 | 7.0 | 9.6 | 11.7 |
| C−D | 75.4 | 113.4 | 6 | 9 | 12 | 15 | 24 | 0.2 | 0.83 | 6.0 | 90 | 12.7 | 15.7 |
| D−E | 10.0 | 123.4 | 6 | 9 | 12 | 15 | 24 | 0.2 | 0.83 | 6.0 | 8.0 | 12.7 | 15.7 |
| E−F | 10.0 | 133.4 | 2 | 3 | 3 | 4 | 25 | 0.1 | 0.40 | 2.0 | 3.0 | 3.4 | 4.4 |
| F−G | 20.0 | 153.4 | 4 | 5 | 6 | 7 | 25 | 0.1 | 0.40 | 4.0 | 5.0 | 6.4 | 7.4 |
| G−H | 78.5 | 231.9 | 4 | 5 | 6 | 7 | 25 | 0.1 | 0.40 | 4.0 | 5.0 | 6.4 | 7.4 |
| H−I | 12.1 | 244.0 | 4 | 5 | 6 | 7 | 25 | 0.1 | 0.40 | 4.0 | 5.0 | 6.4 | 7.4 |
| I−J | 100.0 | 344.0 | 0 | 0 | 0 | 0 | 25 | 0.1 | 0.40 | 0.0 | 0.0 | 0.4 | 0.4 |
| J−K | 15.0 | 359.0 | 0 | 0 | 0 | 0 | 25 | 0.1 | 0.40 | 0.0 | 0.0 | 0.4 | 0.4 |

Fig. 8B

| AA | JJ | | | | KK | | | | LL | | | |
|---|---|---|---|---|---|---|---|---|---|---|---|---|
| | JJ1 | | JJ2 | | KK1 | | KK2 | | LL1 | | LL2 | |
| | MIN | MAX | MIN | MAX | MIN | MAX | MIN | MAX | MIN | MAX | MIN | MAX |
| A−B | 6.38 | 9.89 | 14.59 | 18.64 | −3.2 | −5.5 | −8.4 | −11.1 | 412.8 | 422.0 | 433.6 | 444.2 |
| B−C | 6.38 | 9.89 | 14.59 | 18.64 | −1.1 | −2.2 | −8.4 | −4.7 | 404.0 | 408.8 | 413.6 | 413.8 |
| C−D | 6.38 | 9.89 | 14.59 | 18.64 | 0.0 | 0.0 | 0.0 | 0.0 | 400.0 | 400.0 | 400.0 | 400.0 |
| D−E | 6.38 | 9.89 | 14.59 | 18.64 | 0.0 | 0.0 | 0.0 | 0.0 | 400.0 | 400.0 | 400.0 | 400.0 |
| E−F | 6.38 | 9.89 | 14.59 | 18.64 | −4.3 | −6.6 | −10.7 | −13.4 | 417.0 | 426.4 | 442.8 | 453.7 |
| F−G | 4.17 | 5.26 | 6.81 | 7.96 | 0.0 | 0.0 | 0.0 | 0.0 | 400.0 | 400.0 | 400.0 | 400.0 |
| G−H | 4.17 | 5.26 | 6.81 | 7.96 | 0.0 | 0.0 | 0.0 | 0.0 | 400.0 | 400.0 | 400.0 | 400.0 |
| H−I | 4.17 | 5.26 | 6.81 | 7.96 | 0.0 | 0.0 | 0.0 | 0.0 | 400.0 | 400.0 | 400.0 | 400.0 |
| I−J | 0.00 | 0.00 | 0.00 | 0.00 | 0.0 | 0.0 | 0.4 | 0.4 | 400.0 | 400.0 | 398.4 | 398.4 |
| J−K | 0.00 | 0.00 | 0.00 | 0.00 | 0.0 | 0.0 | 0.4 | 0.4 | 400.0 | 400.0 | 398.4 | 398.4 |

Fig. 14A

| AA | BB | CC | DD | | | | EE | | | FF | | | |
|---|---|---|---|---|---|---|---|---|---|---|---|---|---|
| | | | DD1 | | DD2 | | EE1 | EE2 | EE3 | FF1 | | FF2 | |
| | | | MIN | MAX | MIN | MAX | | | | MIN | MAX | MIN | MAX |
| A—B | 28.0 | 28.0 | 3 | 4 | 5 | 6 | 24 | 0.1 | 0.42 | 3.0 | 4.0 | 5.4 | 6.4 |
| B—C | 10.0 | 38.0 | 5 | 7 | 8 | 11 | 24 | 0.2 | 0.83 | 5.0 | 7.0 | 9.6 | 11.7 |
| C—P | 75.4 | 113.4 | 6 | 9 | 12 | 15 | 24 | 0.2 | 0.83 | 6.0 | 90 | 12.7 | 15.7 |
| P—E | 10.0 | 123.4 | 6 | 9 | 12 | 15 | 24 | 0.2 | 0.83 | 6.0 | 8.0 | 12.7 | 15.7 |
| E—F | 10.0 | 133.4 | 2 | 3 | 3 | 4 | 25 | 0.1 | 0.40 | 2.0 | 3.0 | 3.4 | 4.4 |
| F—Q | 20.0 | 153.4 | 4 | 5 | 6 | 7 | 25 | 0.1 | 0.40 | 4.0 | 5.0 | 6.4 | 7.4 |
| Q—H | 78.5 | 231.9 | 4 | 5 | 6 | 7 | 25 | 0.1 | 0.40 | 4.0 | 5.0 | 6.4 | 7.4 |
| H—I | 12.1 | 244.0 | 4 | 5 | 6 | 7 | 25 | 0.1 | 0.40 | 4.0 | 5.0 | 6.4 | 7.4 |
| I—J | 100.0 | 344.0 | 0 | 0 | 0 | 0 | 25 | 0.1 | 0.40 | 0.0 | 0.0 | 0.4 | 0.4 |
| J—K | 15.0 | 359.0 | 0 | 0 | 0 | 0 | 25 | 0.1 | 0.40 | 0.0 | 0.0 | 0.4 | 0.4 |

Fig. 14B

| AA | JJ | | | | KK | | | | LL | | | |
|---|---|---|---|---|---|---|---|---|---|---|---|---|
| | JJ1 | | JJ2 | | KK1 | | KK2 | | LL1 | | LL2 | |
| | MIN | MAX | MIN | MAX | MIN | MAX | MIN | MAX | MIN | MAX | MIN | MAX |
| A−B | 6.38 | 9.89 | 14.59 | 18.64 | −3.2 | −5.5 | −8.4 | −11.1 | 412.8 | 422.0 | 433.6 | 444.2 |
| B−C | 6.38 | 9.89 | 14.59 | 18.64 | −1.1 | −2.2 | −8.4 | −4.7 | 404.0 | 408.8 | 413.6 | 418.3 |
| C−P | 6.38 | 9.89 | 14.59 | 18.64 | 0.0 | 0.0 | 0.0 | 0.0 | 400.0 | 400.0 | 400.0 | 400.0 |
| P−E | 6.38 | 9.89 | 14.59 | 18.64 | 0.0 | 0.0 | 0.0 | 0.0 | 400.0 | 400.0 | 400.0 | 400.0 |
| E−F | 6.38 | 9.89 | 14.59 | 18.64 | −4.3 | −6.6 | −10.7 | −13.4 | 417.0 | 426.4 | 442.8 | 453.7 |
| F−Q | 4.17 | 5.26 | 6.81 | 7.96 | 0.0 | 0.0 | 0.0 | 0.0 | 400.0 | 400.0 | 400.0 | 400.0 |
| Q−H | 4.17 | 5.26 | 6.81 | 7.96 | 0.0 | 0.0 | 0.0 | 0.0 | 400.0 | 400.0 | 400.0 | 400.0 |
| H−I | 4.17 | 5.26 | 6.81 | 7.96 | 0.0 | 0.0 | 0.0 | 0.0 | 400.0 | 400.0 | 400.0 | 400.0 |
| I−J | 0.00 | 0.00 | 0.00 | 0.00 | 0.0 | 0.0 | 0.4 | 0.4 | 400.0 | 400.0 | 398.4 | 398.4 |
| J−K | 0.00 | 0.00 | 0.00 | 0.00 | 0.0 | 0.0 | 0.4 | 0.4 | 400.0 | 400.0 | 398.4 | 398.4 |

METHOD AND APPARATUS FOR IMAGE FORMING CAPABLE OF PERFORMING A STABLE SHEET TRANSFER OPERATION

BACKGROUND OF THE INVENTION

1. Field of the Invention

The present invention relates to a method and apparatus for image forming, and more particularly to a method and apparatus for image forming that is capable of performing a stable sheet transfer operation.

2. Discussion of the Background

A typical background sheet transferring apparatus used in an image forming apparatus, such as a laser printer, a plain paper copying machine, a facsimile machine, etc., is illustrated in FIG. 1. The background sheet transferring apparatus of FIG. 1 has a sheet passage for a recording sheet traveling from a sheet container 1 through a photoconductive member 12. In FIG. 1, a stack of recording sheets 2 stacked in the sheet container 1 are positioned such that leading edges of the recording sheets 2 are neatly aligned at an initial position A. When a sheet transfer operation is started, a sheet feed signal is turned on in an electrical control system (not shown) and is transmitted to the background sheet transferring apparatus. With the sheet feed signal, a pick-up roller 3 is lowered and is rotated so as to move the recording sheets 2 towards a position B where a sheet separation mechanism is provided. The sheet separation mechanism, namely, a friction reverse roller system includes a feed roller 4 for being rotated to limit and to move one recording sheet 2 forward and a reverse roller 5 for being rotated to move back the accompanying recording sheets 2. The feed roller 4 and the reverse roller 5 are driven at the same time the pick-up roller 3 is driven so that a recording sheet 2 is separated and is transferred forward. In this example, the feed roller 4, the reverse roller 5, and the pick-up roller 3 are driven with a motor (not shown).

After being separated at the position B by the friction reverse roller system, the recording sheet 2 is moved such that the leading edge of the recording sheet 2 reaches a photo sensor 6 located at a position C. Then, the pick-up roller 3 is lifted and is stopped to be driven so that the pick-up roller 3 loses a sheet transfer power for moving the recording sheet 2. After that, the recording sheet 2 is further moved to a transfer roller 7 located at a position E by a sheet transfer power of the feed roller 4. The feed roller 4 is stopped to be driven in a time period t1 (see FIG. 2) after having been driven so that the leading edge of the recording sheet 2 is moved to a position F downstream from the position E. After the feed roller 4 is stopped to be driven, the recording sheet 2 is further transferred by the transfer roller 7. The leading edge of the recording sheet 2 is then brought to pass a photo sensor 8 located at a position H and then to reach a position I when the trailing edge of the recording sheet 2 is brought away from the sheet separation mechanism. After that, the leading edge of the recording sheet 2 is further moved to a transfer roller 9 located at a position E'. In the above operations, the transfer rollers 7 and 9 are driven with a transfer roller driving motor (not shown). The recording sheet 2 is then transferred to a photo sensor 10 (referred to as a registration sensor 10) located at a position J and to a registration roller 11 located at a position K. Further, the recording sheet 2 is transferred to an image transfer section located at a position L and which is composed of the photoconductive member 12 and an image transfer roller 13.

FIG. 2 is a convenient graph with respect to a sheet transferring performance of the background sheet transferring apparatus, which is composed of a performance characteristic graph 1 to a time chart 1. The performance characteristic graph 1 demonstrates a characteristic of a sheet transfer operation of the background sheet transferring apparatus by showing successive positions of leading and trailing edges of a recording sheet in the sheet passage in response to a time parameter. The time chart 1 shows the sheet feed signal and the subsequent actions of the various components in connection with the movement of the recording sheets shown in the performance characteristic graph 1. In the performance characteristic graph 1, the vertical axis represents a distance from the initial position A to a position after the position K and the horizontal axis represents time. In the performance characteristic graph 1, with a time parameter, solid lines represent actual positions of the leading edge of a recording sheet 2 and thick broken lines represent actual positions of the trailing edge of the recording sheet 2. Thin two-dotted chain lines represent calculated positions of the leading edge of the recording sheet 2 without consideration of slippage of the recording sheets 2 relative to the rollers and wearing of the rollers. Thin broken lines represent calculated positions of the trailing edge of the recording sheet 2 without consideration of slippage of the recording sheets 2 relative to the rollers and wearing of the rollers. In this example, the recording sheet 2 has a letter size and is transferred in a direction of a short edge having a length of 216 mm.

In a time period t2 after the leading edge of the recording sheet 2 is brought to reach the registration sensor 10 at the position J, the transfer roller driving motor is stopped so that the transfer rollers 7 and 9 lose sheet transfer powers for moving the recording sheet 2. The time period t2 is determined so that the leading edge of the recording sheet 2 is brought to reach the registration roller 11. At this time, the registration roller 11 is not driven. With this determination of the time period t2, a skew correction is conducted. That is, the leading edge of the recording sheet 2 is brought to collide against the registration roller 11 so that the recording sheet 2 makes a slack before the registration roller 11 which corrects a skew if it exists. In this example, the time period t2 is set to 37.5 ms.

After that, the transfer roller driving motor is driven at the same time the registration roller 11 is driven so that the rotations of the transfer rollers 7 and 9 are restarted. Consequently, the recording sheet 2 is further transferred to the image transfer section so that an image formed on the photoconductive member 12 is transferred onto the recording sheet 2. The registration roller 11 is configured to turn on in a time period t3 after the photo sensor 8 at the position H is turned on. In this example, the time period t3 is set to 400 ms. With this time period t3, the movement of the recording sheet 2 is timed in synchronism with the rotation of the photoconductive member 12 so that the position of the image on the photoconductive member 12 matches the position of the recording sheet 2.

In the performance characteristic graph 1 of FIG. 2, distances of the various positions with reference to the initial position A are set as follows:

28 mm between the positions A and B, 38 mm between the positions A and C, 123.4 mm between the positions A and E, 133.4 mm between the positions A and F, 231.9 mm between the positions A and H, 244 mm between the positions A and I, 344 mm between the positions A and J, 359 mm between the positions A and K, and 216 mm between the positions B and I.

With the arrangement above, the following time periods t11–t16 are needed:

979.75 ms for the time period t11 in which the transfer roller driving motor is driven in synchronism with a rise time of the sheet feed signal;

1048.5 ms for the time period t12 from a rise time of the sheet feed signal to a time the registration roller 11 is turned on;

826.09 ms for the time period t13 from a rise time to the next rise time of the registration roller 11;

755 ms for the time period t14 between calculated times the leading edges of a recording sheet and the next recording sheet are forwarded by the registration roller 11;

252.5 ms for the time period t15 between calculated times the trailing edges of a recording sheet and the next recording sheet are forwarded by the registration roller 11; and 322.82 ms for the time period t16 between a rise time to a fall time of the registration sensor 10.

In addition, the time period t1 represents a time the feed roller 4 is being driven, the time period t2 represents a time from a rise time of the registration sensor 10 to a time the transfer roller driving motor is stopped, the time period t3 represents a time from a rise time of the photo sensor 8 to a time the registration roller 11 is driven, and the time period t4 represents a time from a fall time of the registration sensor 10 to a time the registration roller 11 is stopped.

In the above-described background sheet transferring apparatus, the transfer rollers are apt to lose the sheet transfer powers and the diameters due to wear over time and has a consequent tendency to increasingly cause an excess slippage against the recording sheet 2. This leads to a reduction of the sheet transfer linear speed and adversely affects a printing productivity. More specifically, in the sheet transfer process, the recording sheet 2 is transferred forward while being slipped against the rollers due to a given load such as a load from the reverse roller 5 in the sheet separation mechanism, a load from another recording sheet in close contact, or the like. Largeness of the load depends on the nature of the recording sheet 2, such as a size of the sheet, the surface of the sheet, etc. That is, there is a tendency that the recording sheet 2 suffering a small load causes a small slippage and the recording sheet 2 suffering a large load causes a large slippage. In addition, the recording sheet 2 increasingly causes such slippage with time due to a reduction of the sheet transfer power caused by the following phenomena. This is, the surface of the recording sheet 2 is changed by deposition of a paper dust or wear. Also, the transfer rollers have a friction coefficient $\mu$ which is reduced due to variations of rubber material over time. Furthermore, the reduction of the roller diameters due to wear with time causes another problematic reduction of the sheet transfer linear speed.

FIGS. 3A and 3B show various data associated with the performance of the background sheet transferring apparatus that has the sheet transfer linear speed of 400 mm/s. The data includes a ratio of a sheet slippage, a reduction of a roller diameter, a reduction of the sheet transfer linear speed, and an actual sheet transfer linear speed performed in each part of the sheet passage of the background sheet transferring apparatus. FIGS. 3A and 3B may be read as one data table having columns AA, BB, CC, DD, EE, FF, and GG.

In FIGS. 3A and 3B, the sheet passage is divided into the following passage parts, which are indicated in a column AA of FIGS. 3A and 3B:

A–B represents a passage part between the positions A and B, that is, from the initial position A to the sheet separation mechanism;

B–E represents a passage part between the positions B and E, that is, from the sheet separation mechanism to the transfer roller 7;

E–F represents a passage part between the positions E and F, that is, from the transfer roller 7 to the position F to which the leading edge of the recording sheet 2 is moved when the feed roller 7 is turned off;

F–H represents a passage part between the positions F and H, that is, from the position F to the photo sensor 8;

H–I represents a passage part between the positions H and I, that is, from the photo sensor 8 to the position I to which the leading edge of the recording sheet 2 is moved when the trailing edge of the recording sheet 2 is brought away from the sheet separation mechanism;

I–J represents a passage part between the positions I and J, that is, from the position I to the registration sensor 10;

J–K represents a passage part between the positions J and K, that is, from the registration sensor 10 to the registration roller 11; and K–L represents a passage part between the positions K and L, that is, from the registration roller 11 to the image transfer section.

The components particularly activated and essential in the sheet transfer operations in each of the above-mentioned passage parts of column AA of FIGS. 3A and 3B are as follows:

A–B; the pick-up roller 3,

B–E; the pick-up roller 3 and the feed roller 4,

E–F; the feed roller 4 and the transfer roller 7,

F–H; the transfer roller 7,

H–I; the transfer roller 7,

I–J; the transfer rollers 7 and 9,

J–K; the transfer rollers 7 and 9, and

K–L; the registration roller 11 and the transfer rollers 7 and 9.

Load factors generated as a reverse force against the forward force of the sheet transfer operations in each of the above-mentioned passage parts of column AA of FIGS. 3A and 3B are as follows:

A–B; a close contact power between sheets by friction,

B–E; a close contact power between sheets by friction and a repulsive force from the reverse roller 5, E–F; a close contact power between sheets by friction and a repulsive force from the reverse roller 5, F–H; a repulsive force from the reverse roller 5, H–I; a repulsive force from the reverse roller 5, I–J; no particular load factor, J–K; no particular load factor, and K–L; no particular load factor.

In FIG. 3A, a column BB indicates a distance of each passage part and a column CC indicates an accumulated distance from the initial position A to the end of each passage part. A column DD is a ratio of a sheet slippage expressed as a percent and is divided into an initial condition DD1 and an after-predetermined-time-use condition DD2. Each of DD1 and DD2 is divided into two cases; MIN indicating a sheet slippage ratio under a minimum load and MAX indicating a sheet slippage ratio under a maximum load. A column EE indicates a diameter of the roller associated with the sheet transfer operations in each passage part. The column EE is divided into EE1–EE3: EE1 is an initial diameter; EE2 is a radial reduction amount expressed in a percent due to the wear after a relatively long time use, and E3 is an amount of reduction in the sheet transfer linear speed expressed in a percent due to the reduction of the roller diameter. In FIG. 3B, a column FF indicates an amount of a total reduction in the sheet transfer linear speed expressed in a percent, in which wear of the reverse roller 5 is taken into consideration. The column FF is divided into an initial condition FF1 and an after-predetermined-time-use condition FF2. Each of FF1 and FF2 is divided into two cases; MIN indicating a total reduction in the sheet transfer linear speed expressed in a percent under a minimum load and MAX indicating a total reduction in the sheet transfer linear speed expressed in a percent under a maximum load. A column GG indicates an actual sheet transfer linear speed. The column GG is divided into an initial condition GG1 and an after-predetermined-time-use condition GG2. Each of GG1 and GG2 is divided into two cases; MIN indicating the actual sheet transfer linear speed under a minimum load and MAX indicating the actual sheet transfer linear speed under a maximum load.

The data of the actual sheet transfer linear speed under the initial condition GG1 is referred to as GG1-MIN in the case the minimum load is provided and as GG1-MAX in the case the maximum load is provided. Likewise, the data of the actual sheet transfer linear speed under the after-predetermined-time-use condition GG1 is referred to as GG2-MIN in the case the minimum load is provided and as GG2-MAX in the case the maximum load is provided. For example, the solid lines and thick broken lines shown in the performance characteristic graph 1 of FIG. 2 are based on GG2-MAX.

In a similar manner, FIG. 4 demonstrates a linear speed graph expressing cases Z1, Z2, Z3, and Z4 based on GG1-MIN, GG1-MAX, GG2-MIN, and GG2-MAX, respectively, of FIGS. 3A and 3B. In FIG. 4, sheet transfer cycles from a recording sheet 2 to the next recording sheet 2 at the registration roller 11 in a continuous sheet feeding mode in the cases Z1, Z2, Z3, and Z4 are referred to as Z1*a*, Z2*a*, Z3*a*, and Z4*a*, respectively. Also, time differences from the trailing edge of a recording sheet 2 to the leading edge of the next recording sheet 2 at the registration roller 11 in the continuous sheet feeding mode in the cases Z1, Z2, Z3, and Z4 are referred to as Z1*b*, Z2*b*, Z3*b*, and Z4*b*, respectively.

Based on the above-mentioned sheet transfer cycles Z1*a*–Z4*a*, corresponding copy speeds of the image forming apparatus employing the sheet transferring apparatus are calculated in the following manner. In the case Z1, the sheet transfer cycle Z1*a* is 784.14 ms per a sheet and therefore the copy speed is obtained by dividing a minute by 784.14 ms, that is, 76.52 cpm (copy per minute). Likewise, in the case Z2, the sheet transfer cycle Z2*a* is 796.23 ms per a sheet and therefore the copy speed is 75.36 cpm. In the case Z3, the sheet transfer cycle Z3*a* is 812.60 ms per a sheet and therefore the copy speed is 73.84 cpm. In the case Z4, the sheet transfer cycle Z4*a*, the copy speed is 72.63 cpm. From the calculations above, it should be understood in both the initial condition and the after-predetermined-time-use condition that the greater the load against the sheet transfer, the lesser the copy speed.

Further, based on the above-mentioned time differences Z1*b*–Z4*b*, corresponding distances from the trailing edge of a recording sheet 2 to the next recording sheet 2 at the registration roller 11 in the continuous sheet feeding mode in the cases Z1, Z2, Z3, and Z4 are calculated in the following manner. In the case Z1, the time difference Z1*b* is 281.64 ms and therefore the distance is obtained by multiplying the time difference by the initial linear speed of the registration roller 11, that is, 0.28164 s multiplied by 400 mm/s which is equal to 112.66. Likewise, in the case Z2, the time difference Z2*b* is 293.73 ms and therefore the distance is 0.29373 s multiplied by 400 mm/s which is equal to 117.49 mm. In the case Z3, the time difference Z3*a* is 309.34 ms and therefore the distance is 0.30934 s multiplied by 399.4 mm/s which is equal to 123.55 mm. In the case Z4, the time difference Z4*a* is 322.82 ms and therefore the distance is 0.32282 s multiplied by 399.4 mm/s which is equal to 128.93 mm. From the calculations above, it should be understood in both the initial condition and the after-predetermined-time-use condition that the greater the load against the sheet transfer, the lesser the copy speed.

As such, the distance between the adjacent recording sheets in the continuous sheet feeding mode, which are worthless for the print operation, is growing. The sheet transfer linear speed after the registration roller 11 is predetermined as 400 mm/s in the initial condition and is reduced to 399.4 mm/s in the after-predetermined-time-use condition. That is, a difference between the sheet transfer linear speeds in the above-mentioned conditions is relatively small. Therefore, it should be understood that the growing difference between the adjacent recording sheets after the registration roller 11 is a major factor that adversely affects the printing productivity.

SUMMARY OF THE INVENTION

This patent specification describes a novel sheet transferring apparatus for use in an image forming apparatus. In one example, this novel sheet transferring apparatus includes a sheet transferring mechanism and a controller. The sheet transferring mechanism is arranged and configured to transfer a recording sheet at a transfer speed to an image forming mechanism in the image forming apparatus. The controller is arranged and configured to determine the transfer speed based on a transfer speed used for an immediately previous recording sheet.

The sheet transferring mechanism may include a transfer roller and at least two sensors. The two sensors are arranged and configured to detect a recording sheet being transferred. The two sensors are mounted with a predetermined distance from each other.

The controller may determine the transfer speed using an equation;

$$VR(n)=\{VR(n-1)\}^2/V(n-1), \quad (5)$$

wherein n is an integer greater than 1, VR(n) represents a linear speed of the transfer roller when transferring an nth recording sheet, VR(n−1) represents a linear speed of the transfer roller during a transfer of an (n−1)th recording sheet, and V(n−1) represents a moving speed of the (n−1)th recording sheet. When the n is equal to 1, the linear speed VR(1) is set to a predetermined value.

The controller may apply a correction tolerance of ±5% to the equation (5) so that the transfer roller is driven at the linear speed R(n) within a range of;

$$[\{VR(n-1)\}^2/V(n-1)]\times 0.95 \leqq R(n) \leqq [\{VR(n-1)\}^2/V(n-1)]\times 1.05. \quad (6)$$

The controller may determine the transfer speed using an equation;

$$VR(n)=[\{VR(n-1)\}^2\times T(n-1)]/L, \quad (7)$$

wherein n is an integer greater than 1, VR(n) represents a linear speed of the transfer roller when transferring an nth recording sheet, VR(n−1) represents a linear speed of the transfer roller during a transfer of an (n−1)th recording sheet, L represents the predetermined distance, and T(n−1) represents a time period in which the (n−1)th recording sheet is moved the predetermined distance. The n is equal to 1 the linear speed VR(1) is set to the predetermined value.

This patent specification further describes a novel image forming apparatus. In one example, this novel image forming apparatus includes an image forming mechanism, a sheet transferring mechanism, and a controller. The image forming mechanism is arranged and configured to form a visible image on a recording sheet. The sheet transferring mechanism is arranged and configured to transfer the recording sheet at a transfer speed to the image forming mechanism. The controller is arranged and configured to control a number of revolutions of a motor for driving the transfer roller to determine said transfer speed based on a transfer speed used for an immediately previous recording sheet.

This patent specification further describes a novel image forming system. In one example, this novel image forming includes an image forming apparatus and an operation apparatus. The image forming apparatus includes an image forming mechanism, a sheet transferring mechanism, and a controller. The image forming mechanism is arranged and configured to form a visible image on a recording sheet. The sheet transferring mechanism is arranged and configured to transfer the recording sheet at a transfer speed to the image forming mechanism. The controller is arranged and configured to determine the transfer speed based on a transfer speed used for an immediately previous recording sheet. The operation apparatus includes a display for indicating a warning that the sheet transfer mechanism is in a condition asking for an inspection in accordance with an instruction from the image forming apparatus when the transfer speed is varied out of predetermined limits.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 3A and 3B are data tables showing various performance data of the sheet transferring operation of the background sheet transferring apparatus of FIG. 1;

FIGS. 8A and 8B are data tables showing various performance data of the sheet transferring operation of the sheet transferring mechanism of FIG. 6;

FIGS. 14A and 14B are data tables showing various performance data of the sheet transferring operation of the sheet transferring mechanism of FIG. 11.

DETAILED DESCRIPTION OF PREFERRED EMBODIMENTS

Figure 5:
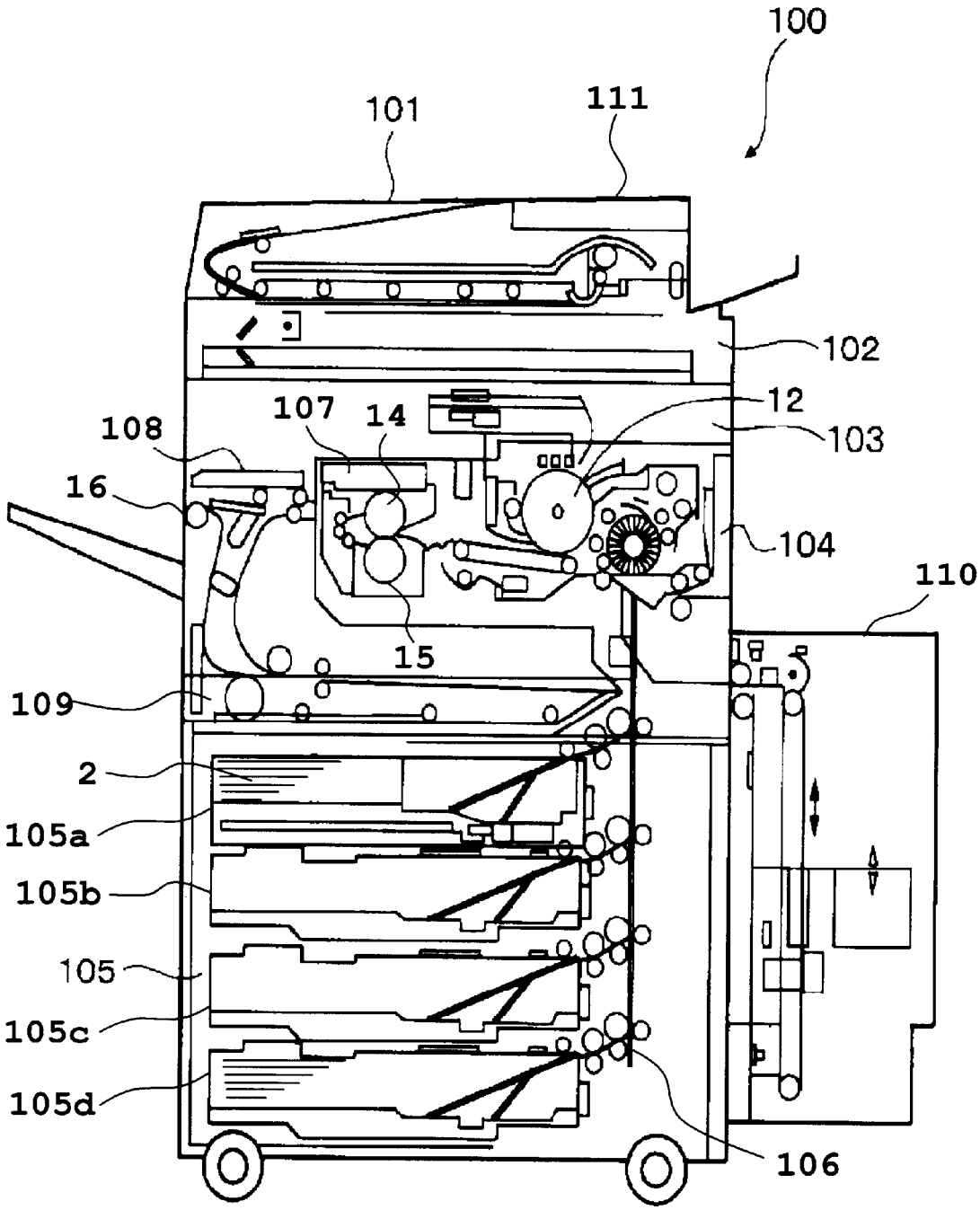
FIG. 5 is a schematic diagram of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 5, a description is made for an electrophotographic image forming apparatus 100 according to a preferred embodiment of the present invention. The image forming apparatus 100 of FIG. 5 performs an optical image reading operation for optically reading an original document sheet and an image forming operation for forming an image based on the image reading operation in accordance with a known electrophotographic method. Therefore, as shown in FIG. 5, the image forming apparatus 100 includes a document feed unit 101, a document reading unit 102, an optical writing unit 103, an image forming unit 104, a recording sheet container 105, a sheet transferring mechanism 106, a fixing unit 107, and a sheet ejection unit 108. The image forming apparatus 100 further includes optional equipment such as, for example, a duplex print unit 109 for printing an image on a reverse side of recording sheets and a large capacity input tray 110 capable of containing a relatively large capacity for recording sheets. The image forming apparatus 100 further includes an operation console 111 including various keys for inputting operator instructions and a display for indicating various kind of information including machine statuses.

Further, in FIG. 5, the image forming unit 104 includes a photoconductive drum 12. The fixing unit 107 includes fixing rollers 14 and 15 for heat and pressure, respectively. The recording sheet container 105 includes sheet cassettes 105*a*, 105*b*, 105*c*, and 105*d* each of which contains a stack of recording sheets 2, for example. The sheet ejection unit 108 includes an ejection roller 16.

The document feed unit 101 is an automatic document feeder (ADF) that automatically inputs an original document sheet and brings it to pass by an image reading position relative to the document reading unit 102 so that the document reading unit 102 reads an image of the original document sheet. After inputting, the document feed unit 101 ejects the original document sheet after the reading process.

The document reading unit 102 includes a reading light source, a movable light reflection mechanism, a lens system, and a CCD (charge-coupled device), which are not shown. In the document reading unit 102, the reading light source is energized to emit light to an original document sheet, and the movable light reflection mechanism is moved in a sub-scanning direction to sequentially receive and deflect the light reflected from the original document sheet. Via the lens system, the deflected light is brought into a focus on the CCD which outputs an electrical signal in response to an input of the light. In this way, image information of the original document sheet is optically read and is converted into an electrical signal. Thus, an image signal is generated.

The image signal is subjected to various image processing operations required before the image forming operation, and is then used to modulate light emitted from a writing light source, i.e., a laser diode (LD) 20 (see FIG. 7), in the optical writing unit 103. The optical writing unit 103 includes an optical system that includes the writing light source, a polygon mirror, lenses, mirrors, etc., which are not shown. In the optical writing unit 103, the modulated light is deflected with continuously varying angles in a main scanning direction to the photoconductive drum 12 of the image forming unit 104. Thereby, the surface of the photoconductive drum 12 is scanned with the light modulated in accordance with the image of the original document sheet.

The image forming unit 104 forms an image according to electrophotographic and therefore includes various known components such as the photoconductive drum 12, a charging member, a development unit, a transfer roller 13 (FIG. 6), a separation unit, a cleaning unit, a discharging unit, most of which are not shown. These units are arranged around the photoconductive drum 12 and act to form an electrostatic latent image on the surface of the photoconductive drum 12 based on the scanning operation with the modulated light and to visualize the electrostatic latent image into a toner image. While the toner image is generated in this way, the recording sheet 2 is supplied from the recording sheet container 105 and is transferred to the photoconductive drum 12 through the sheet transferring mechanism 106. After that, the toner image is transferred onto the recording sheet 2 by the transfer roller 13 and is fixed on the recording sheet 2 by the heat roller 14 and the pressure roller 15 of the fixing unit 107. Then, the recording sheet 2 having the toner image fixed thereon is ejected outside the image forming apparatus by the ejection roller 16 of the sheet ejection unit 108.

Figure 1:
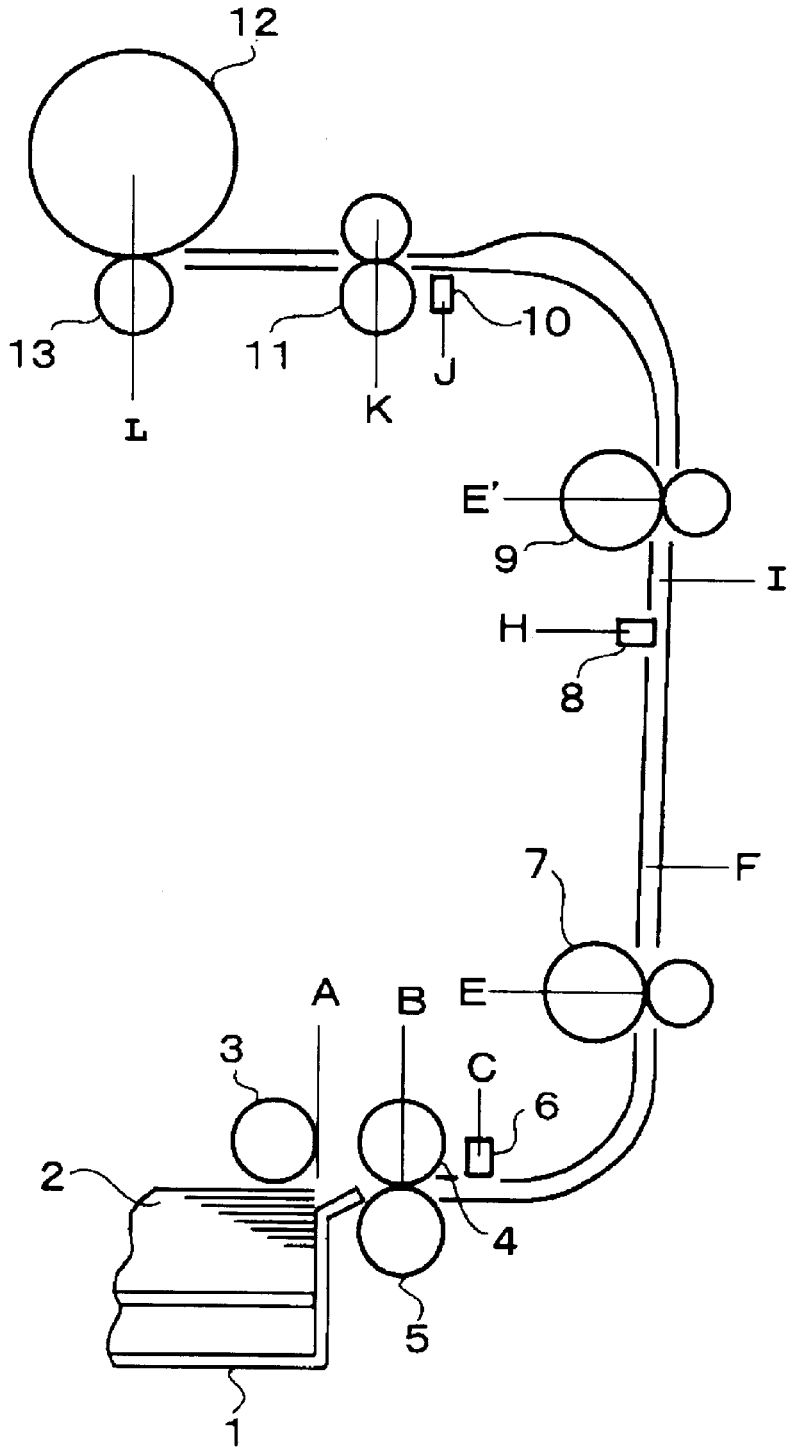
Fig. 1 (PRIOR ART)
FIG. 1 is an illustration showing a background sheet transferring apparatus.
Figure 2:
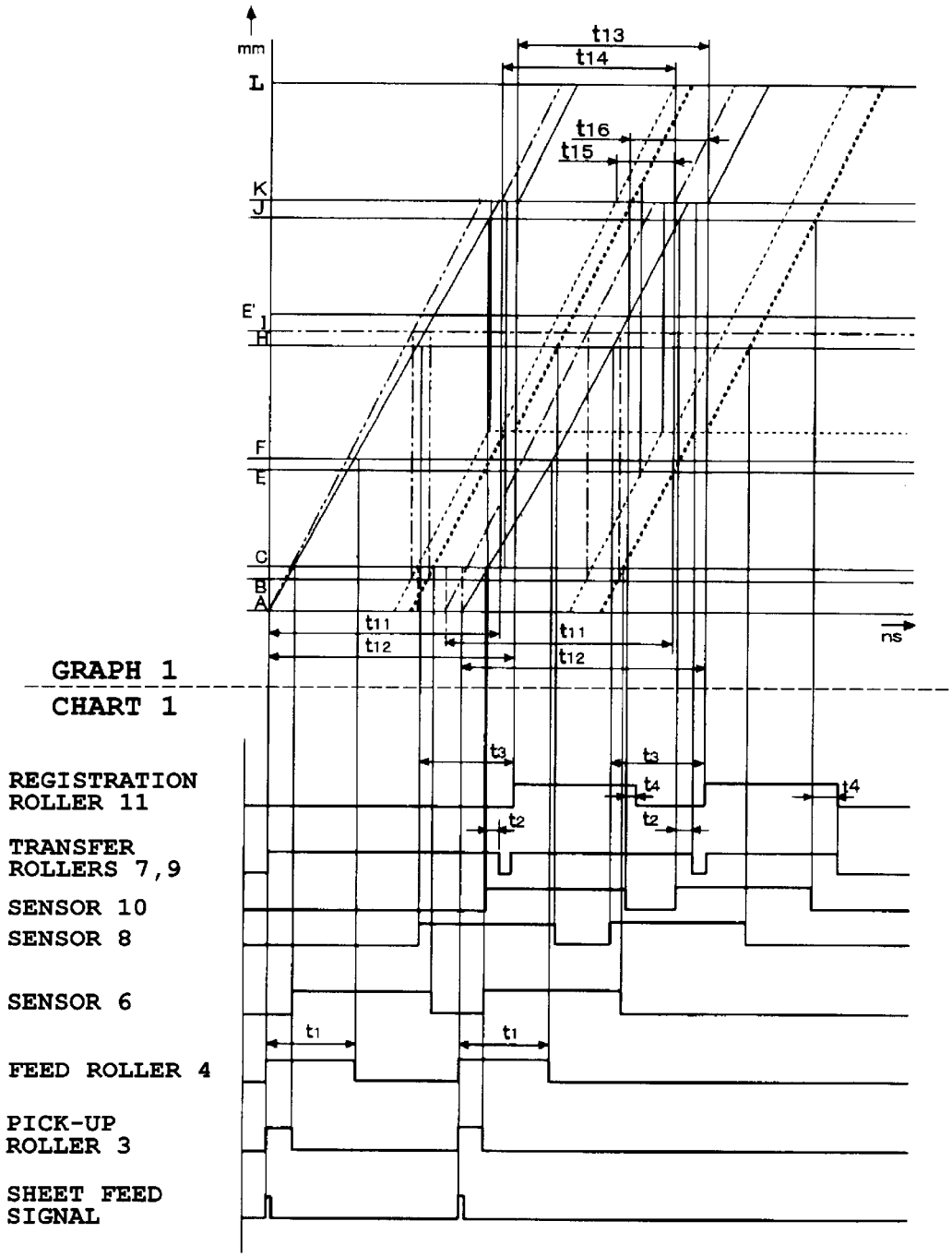
Fig. 2 (PRIOR ART)
FIG. 2 is a performance chart connected with a time chart for explaining a sheet transferring operation of the background sheet transferring apparatus of FIG. 1.
Figure 4:
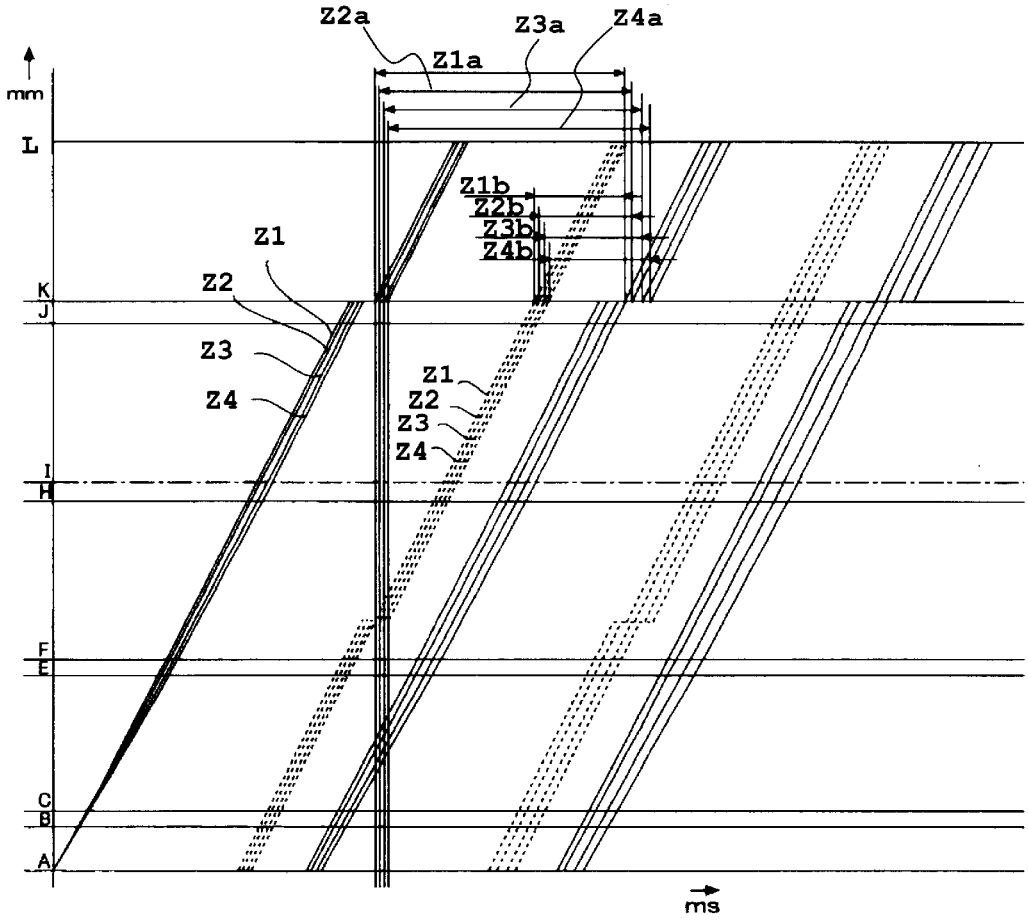
Fig. 4 (PRIOR ART)
FIG. 4 is a performance chart made based on the data of FIGS. 3A and 3B.
Figure 6:
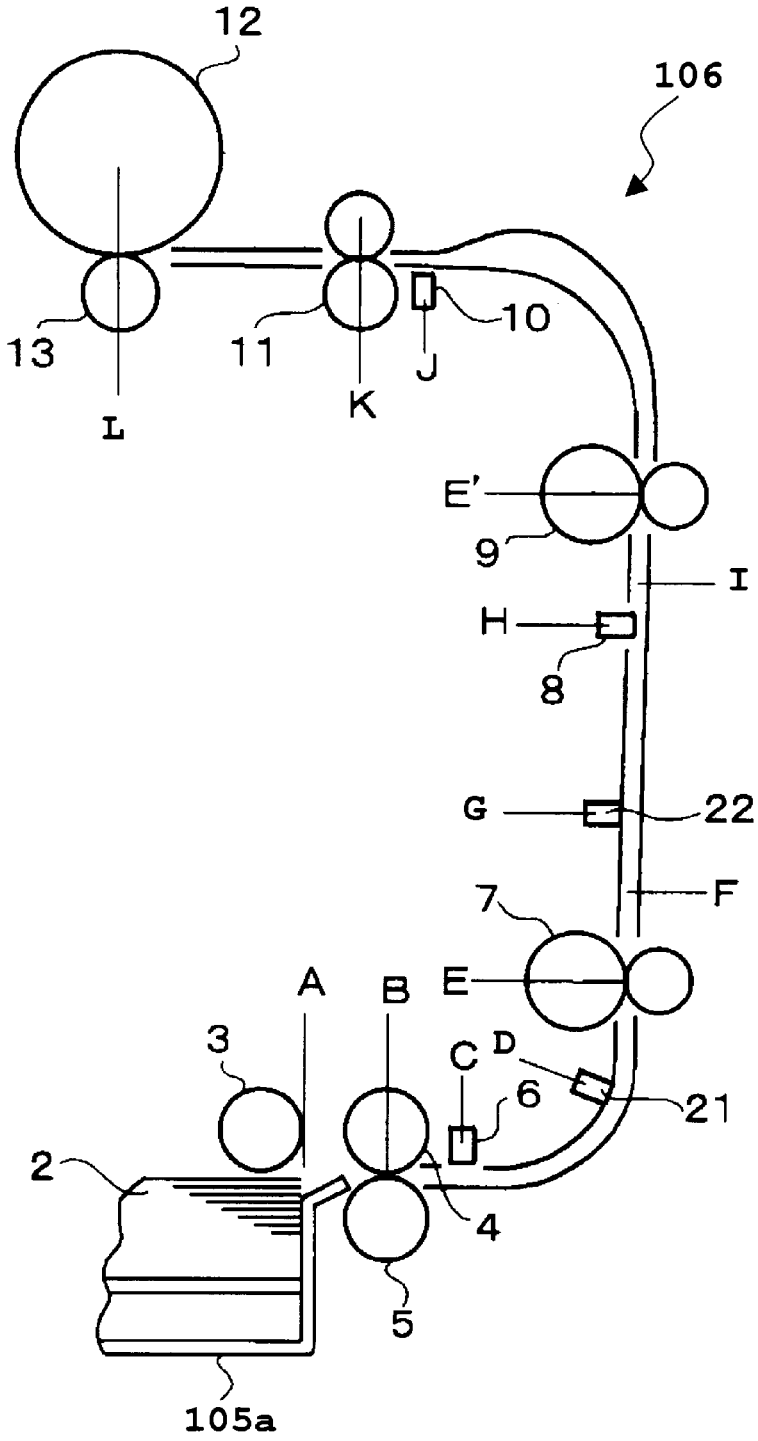
FIG. 6 is an illustration of a sheet transferring mechanism included in the image forming apparatus of FIG.

FIG. 6 shows an exemplary structure of the sheet transferring mechanism 106 according to a preferred embodiment of the present invention is explained. The sheet transferring mechanism 106 is similar to the background sheet transferring apparatus of FIG. 1, except for velocity sensors 21 and 22. The sheet transferring mechanism 106 is provided with the velocity sensor 21 at a position D and the velocity sensor 22 at a position G, as shown in FIG. 6. The velocity sensors 21 and 22 are laser Doppler velocity sensors for detecting linear speed of the recording sheet being transferred. The sheet transferring mechanism 106 feeds the recording sheet 2 from the sheet cassette 105*a*, for example, and transfers it in a way similar to that of the background sheet transferring apparatus of FIG. 1, except for an RPM (revolutions per minute) control, explained later, for controlling an RPM (revolutions per minute) of motors associated with in response to the linear speed of the recording sheet 2 detected by the velocity sensors 21 and 22. A correction of the RPM made by the RPM control may be referred to as an RPM correction.

The position D may be anywhere between the positions C and E but is, in this example, set to a place having a distance equivalent to a perimeter of the feed roller 4 downstream from the position C in the sheet transferring direction, for example. The velocity sensor 21 detects the linear speed of the recording sheet 2 during the time the leading edge of the recording sheet 2 is fed in an area between the positions C and E. Also, the position G may be anywhere between the positions F and H but is, in this example, set to a place having a distance equivalent to a perimeter of the transfer roller 7 upstream from the position H in the sheet transferring direction, for example. The velocity sensor 22 detects the linear speed of the recording sheet 2 during the time the leading edge of the recording sheet 2 is fed in an area between the positions F and H.

Figure 7:
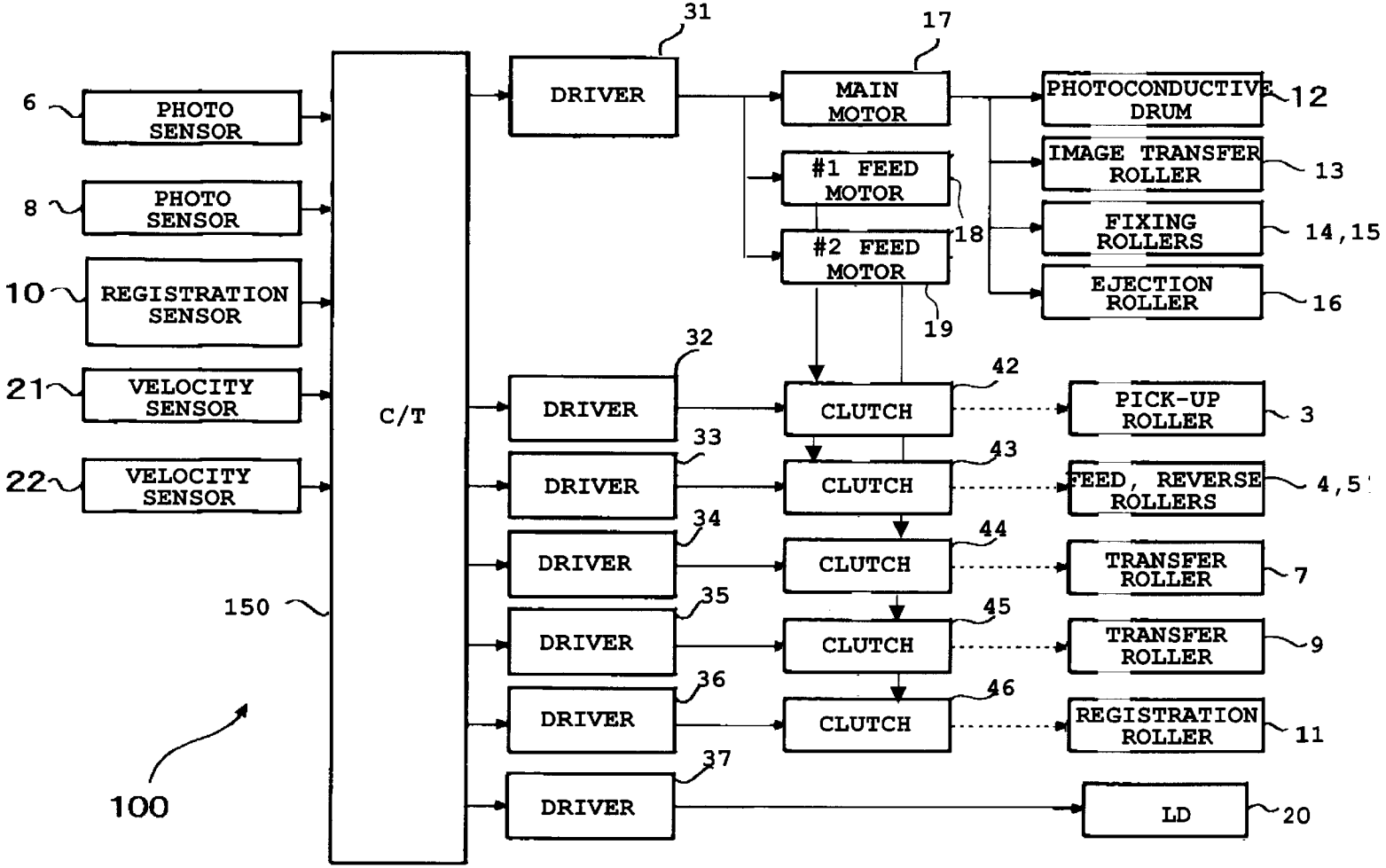
FIG. 7 is a block diagram of an electric system of the image forming apparatus of FIG. 5.

Referring to FIG. 7, a block diagram of an exemplary electric system employed in the above-described image forming apparatus 100 is explained. As shown in FIG. 7, the image forming apparatus 100 is provided with a controller 150 that electrically controls the operations of the image forming apparatus 100, including the image forming operations and the sheet transferring operations.

In this example, the image forming apparatus 100 is provided with driving sources including a main motor 17, a first feed motor 18, and a second feed motor 19, as shown in FIG. 7. The main motor 17 drives the photoconductive drum 12, the image transferring roller 13, the fixing rollers 14 and 15, and the ejection roller 16. The first feed motor 18 drives the pick-up roller 3, the feed roller 4, and the reverse roller 5. The second feed motor 19 drives the transfer rollers 7 and 9.

Also, the image forming apparatus 100 is provided with drivers 31 for driving the above-mentioned motors 17–19. The image forming apparatus 100 is further provided with drivers 32–36 and clutches 42–46 for transmitting the power of the first and second motors 18 and 19 to the associated rollers of the sheet transferring mechanism 106. The image forming apparatus 100 is further provided with a driver 37 for driving the laser diode 20 with the signal modulated in accordance with the image of the original document sheet.

The driver 31 controls the main motor 19 that drives the photoconductive drum 12, the transfer roller 13, the fixing rollers 14 and 15, and the ejection roller 16. The driver 31 further controls the motor 17 that drives the pick-up roller 3, the feed roller 4, and the reverse roller 5. The driver 31 further controls the motor 18 that drives the transfer rollers 7 and 9, and the registration roller 11.

The driver 32 drives the clutch 42 to transmit the power of the motor 18 to the pick-up roller 3. The drivers 33 drives the clutch 43 to energize the feed and reverse rollers 4 and 5 with the power of the motor 17. The drivers 34 and 35 drive the clutches 44 and 45, respectively, to rotate the transfer rollers 7 and 9, respectively, with the power of the motor 18. The driver 36 drives the clutch 46 to rotate the registration roller 11 with the power of the motor 18.

In the controller 150, a CPU (central processing unit) performs various operations, including the image reading operation and the image forming operation, in accordance with a program software stored in a ROM (read only memory) using a RAM (random access memory) as a working memory in which information required for the operations performed by the CPU is stored on an as needed basis.

The controller 150 performs the RPM control that controls an RPM (revolutions per minute) of the first and second feed motors 18 and 19 in response to the linear speed of the recording sheet 2 detected by the velocity sensors 21 and 22. In a discussion of this RPM control, several terms are defined as follows. The RPM of the feed roller 4 is one-xth of the RPM of the first feed motor 18, and the RPM of the transfer rollers 7 and 9 are one-yth of the RPM of the second feed motor 19, wherein the x and the y are any number greater than zero. When a first recording sheet 2 is fed forward in the sheet passage by the feed roller 4 driven by the first feed motor 18 under the RPM control of the controller 150, an RPM of the feed roller 4 that drives the first recording sheet 2 is defined as R1. Accordingly, the RPM of the first motor 18 is R1 multiplied by x. Likewise, when the first recording sheet 2 is fed by the transfer rollers 7 and 9 driven by the second feed motor 19 under the RPM control of the controller 150, an RPM of the transfer rollers 7 and 9 that drive the first recording sheet 2 is defined as R'1. Accordingly, the RPM of the second motor 19 is R'1 multiplied by y.

An actual linear speed of the first recording sheet 2 measured during the time the leading edge thereof is moved between the positions C and D is defined as V1. An actual linear speed of the first recording sheet 2 measured during the time the leading edge thereof is moved between the positions F and H is defined as V'1. An outer diameter of the feed roller 4 is defined as Df. An outer diameter of the transfer rollers 7 and 9 is defined as De. An ideal linear speed of the recording sheet 2 being moved between the positions C and D is defined as V0, given no consideration of a speed reduction due to slippage or wear of the rollers. The ideal linear speed V0 satisfies an equation;

$$V0=\pi\times Df\times R1.$$

An ideal linear speed of the recording sheet 2 being moved between the positions C and D is defined as V'0, given no consideration of a speed reduction due to slippage or wear of the rollers. The ideal linear speed V'0 satisfies an equation;

$$V'0=\pi\times De\times R'1.$$

The RPM of the feed roller 4 during a transfer of a second recording sheet 2 following the first recording sheet 2 is defined as R2. The RPM of the transfer rollers 7 and 9 during a transfer of the second recording sheet 2 following the first recording sheet 2 is defined as R'2.

In the RPM control performed by the controller 150, the RPM R2 and the RPM R'2 are controlled to satisfy the following equations;

$$R2=(\pi\times Df\times R1^2)/V1=(V0/V1)\times R1,$$

and $$R'2=(\pi\times De\times R'1^2)/V'1=(V'0/V'1)\times R'1.$$

On and after a third recording sheet 2 following the second recording sheet 2, the RPM of the feed roller 4 and the RPM of the transfer rollers 7 and 9 during a transfer of the nth recording sheet 2 can be expressed as R(n) and R'(n), respectively, and the respective equations can be modified as follows, wherein n is an integer greater than 2;

$$R(n)=[\pi\times Df\times\{R(n-1)\}^2]/V(n-1),$$

and $$R'(n)=[\pi\times De\times\{R'(n-1)\}^2]/V'(n-1).$$

That is, a linear speed at which a recording sheet 2 is transferred is defined with a parameter of the linear speed of the previously transferred recording sheet 2 in a continuous sheet transferring mode. Therefore, the above equations can be expressed in the following more generic equation;

$$R(n)=[\pi\times D\times\{R(n-1)\}^2]/V(n-1), \quad (1)$$

wherein R(n) represents an RPM of the transfer roller when transferring the nth recording sheet 2, D represents an outer diameter of the transfer roller, R(n−1) represents an RPM of the transfer roller during a transfer of the (n−1)th recording sheet 2, and V(n−1) represents a linear speed of the (n−1)th recording sheet 2.

FIGS. 8A and 8B show various data associated with the performance of the sheet transferring mechanism 106 that has the sheet transfer linear speed of 400 mm/s. FIGS. 8A and 8B may be read as one data table having columns AA, BB, CC, DD, EE, FF, JJ, KK, and LL.

In FIGS. 8A and 8B, the sheet passage is divided into the following passage parts as indicated in a column AA:

A–B represents a passage part between the positions A and B, that is, from the initial position A to the sheet separation mechanism;

B–C represents a passage part between the positions B and C, that is, from the sheet separation mechanism to the photo sensor 6;

C–D represents a passage part between the positions C and D, that is, from the photo sensor 6 to the velocity sensor 21;

D–E represents a passage part between the positions D and E, that is, from the velocity sensor 21 to the transfer roller 7;

E–F represents a passage part between the positions E and F, that is, from the transfer roller 7 to the position F to which the leading edge of the recording sheet 2 is moved when the feed roller 7 is turned off;

F–G represents a passage part between the positions F and G, that is, from the position F to which the leading edge of the recording sheet 2 is moved when the feed roller 7 is turned off to the velocity sensor 22;

G–H represents a passage part between the positions G and H, that is, from the velocity sensor 22 to the photo sensor 8;

H–I represents a passage part between the positions H and I, that is, from the photo sensor 8 to the position I to which the leading edge of the recording sheet 2 is moved when the trailing edge of the recording sheet 2 is brought away from the sheet separation mechanism;

I–J represents a passage part between the positions I and J, that is, from the position I to the registration sensor 10; and J–K represents a passage part between the positions J and K, that is, from the registration sensor 10 to the registration roller 11.

The components particularly activated and essential in the sheet transfer operations in each of the above-mentioned passage parts of the column AA of FIG. FIGS. 8A and 8B are as follows:

A–B; the pick-up roller 3,

B–C; the pick-up roller 3 and the feed roller 4,

C–D; the feed roller 4,

D–E; the feed roller 4,

E–F; the feed roller 4 and the transfer roller 7,

F–G; the transfer roller 7,

G–H; the transfer roller 7,

H–I; the transfer roller 7,

I–J; the transfer rollers 7 and 9, and

J–K; the transfer rollers 7 and 9.

Load factors generated as a reverse force against the forward force of the sheet transfer operations in each of the above-mentioned passage parts of column AA of FIGS. 8A and 8B are as follows:

A–B; a close contact power between sheets by friction,

B–C; a close contact power between sheets by friction and a repulsive force from the reverse roller 5, C–D; a close contact power between sheets by friction and a repulsive force from the reverse roller 5, D–E; a close contact power between sheets by friction and a repulsive force from the reverse roller 5, E–F; a close contact power between sheets by friction and a repulsive force from the reverse roller 5, F–G; a repulsive force from the reverse roller 5, G–H; a repulsive force from the reverse roller 5, H–I; a repulsive force from the reverse roller 5, I–J; no particular load factor, and J–K; no particular load factor.

As in the cases of FIGS. 3A and 3B, FIGS. 8A and 8B may be read as one data table having columns AA, BB, CC, DD, EE, FF, JJ, KK, and LL. The columns AA, BB, CC, DD, and EE in FIGS. 8A and 8B are defined in the same manner as those of FIGS. 3A and 3B. The column JJ of FIG. 8B indicates a corrective increase in percent of the RPMs of the respective first and second motors 18 and 19 according to the RPM control based on the measured linear speed of the recording sheet 2 in each of the passage parts shown in the column AA. The column JJ is divided into an initial condition JJ1 and an after-predetermined-time-use condition JJ2. Each of JJ1 and JJ2 is divided into two cases; MIN indicating a corrective increase of the RPM in percent under a minimum load and MAX indicating a corrective increase of the RPM in percent under a maximum load.

The column KK of FIG. 8B indicates a resultant decrease in percent of the linear speed of the recording sheet 2 in response to the corrective increase of the RPM of the first and second motors 18 and 19 in each of the passage parts shown in the column AA. In this case, wear of the transfer rollers 7 and 9 are taken into consideration. The column KK is divided into an initial condition KK1 and an after-predetermined-time-use condition KK2. Each of KK1 and KK2 is divided into two cases; MIN indicating a resultant decrease of the linear speed of the recording sheet 2 in percent under a minimum load and MAX indicating a resultant decrease of the recording sheet 2 in percent under a maximum load.

Although the column LL of FIG. 8B is defined in a manner similar to the column GG of FIG. 3B, there is a difference that the column LL indicates an actual sheet transfer linear speed reflecting the correction according to the RPM control. As in the case of the column GG of FIG. 3B, the column LL of FIG. 8B is divided into an initial condition LL1 and an after-predetermined-time-use condition LL2. Each of LL1 and LL2 is divided into two cases; MIN indicating the actual corrected sheet transfer linear speed under a minimum load and MAX indicating the actual corrected sheet transfer linear speed under a maximum load.

Figure 9:
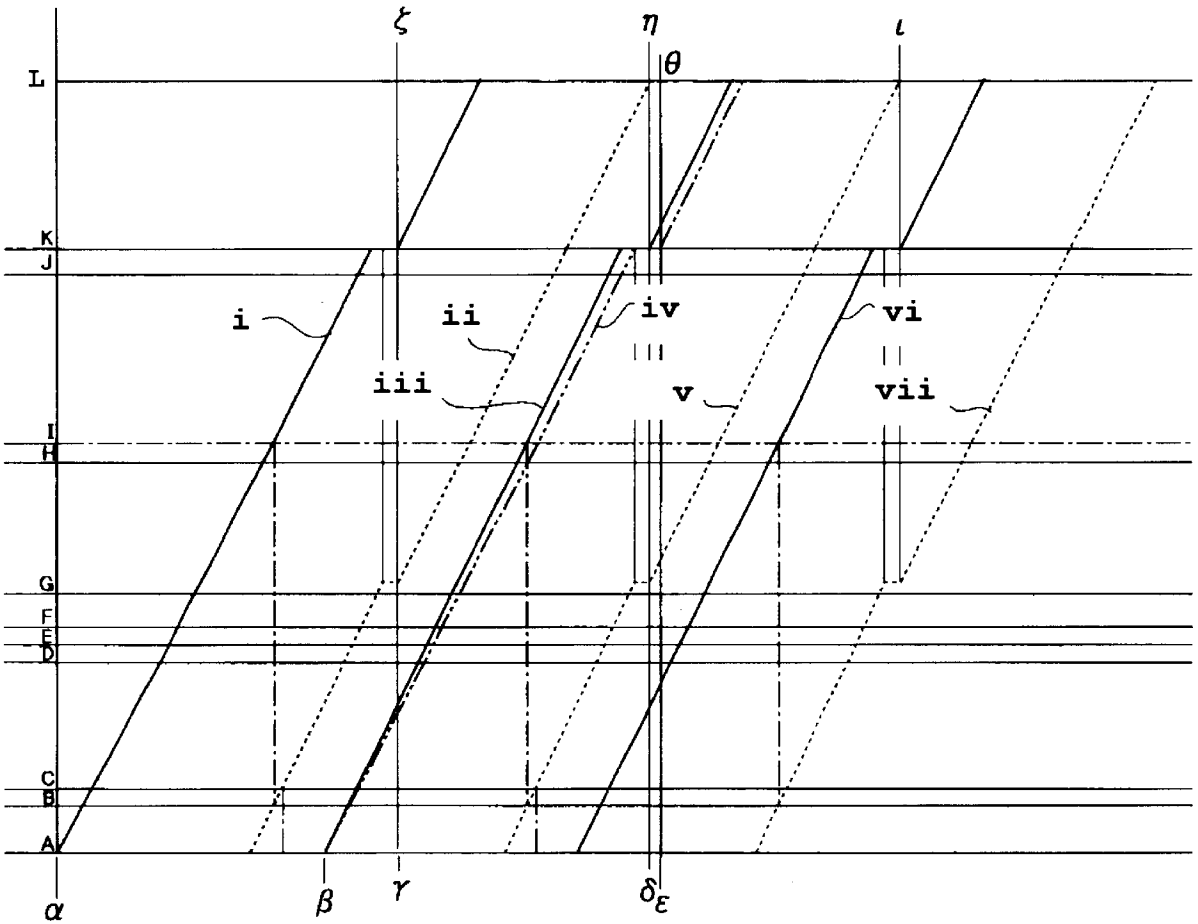
FIGS. 9 and 10 are performance charts made based on the data of FIGS. 8A and 8B.

FIG. 9 is a graph showing a performance characteristic of the sheet transferring mechanism 106 with the horizontal axis of time and the vertical axis of the positions of the leading and trailing edges of the recording sheet 2. The graph of FIG. 9 is based on the sheet transfer during the initial condition LL1 under the minimum transfer load MIN in the column LL of FIG. 8B. In FIG. 9, reference numeral i represents the positions of the leading edge of the first recording sheet 2 with no correction, ii represents the positions of the trailing edge of the first recording sheet 2 with no correction, and iii represents the positions of the leading edge of the second recording sheet 2 with the correction. Further, reference numeral iv represents the positions of the leading edge of the second recording sheet 2 with no correction, v represents the positions of the trailing edge of the second recording sheet 2 with the correction, vi represents the positions of the leading edge of the third recording sheet 2 with the correction, and vii represents the positions of the trailing edge of the third recording sheet 2 with the correction.

Figure 10:
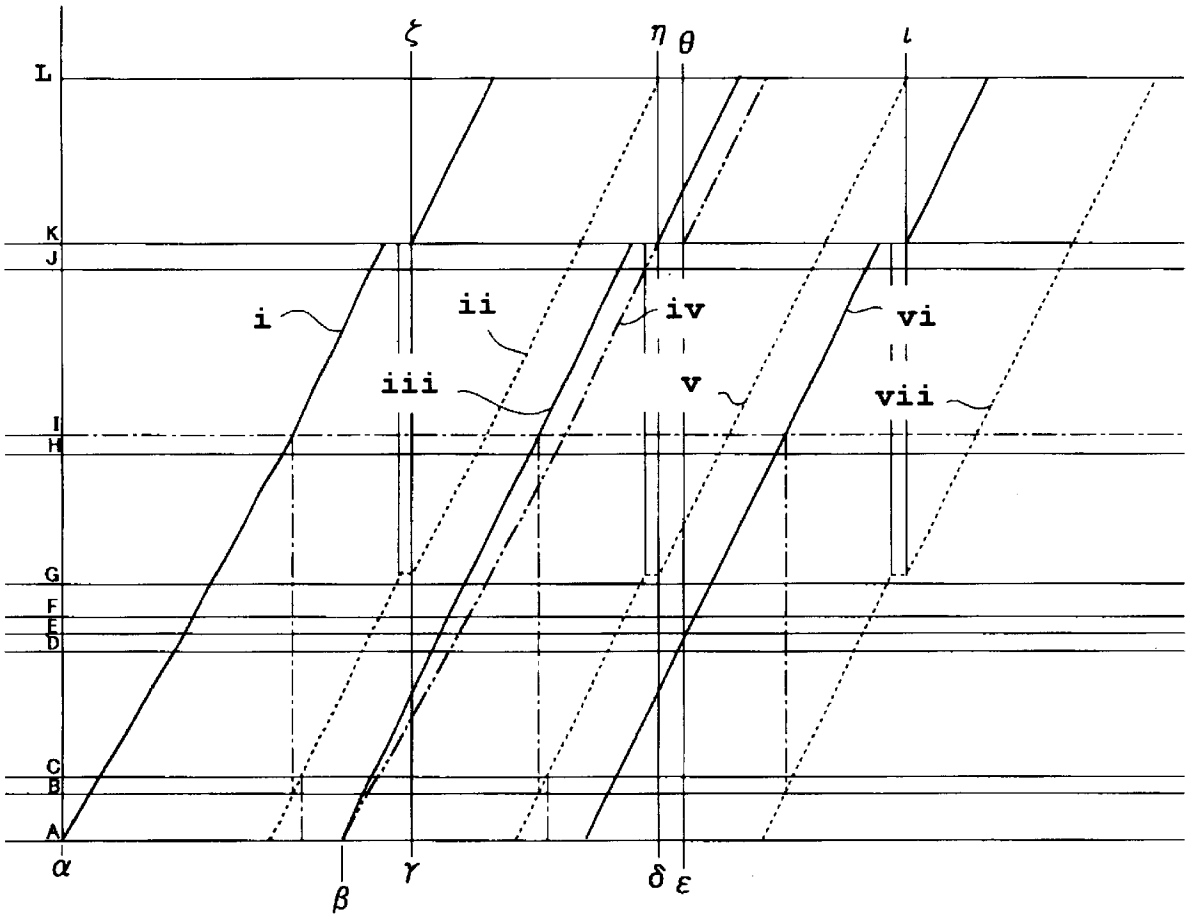

In a similar manner, FIG. 10 is a graph showing a performance characteristic of the sheet transferring mechanism 106 and is based on the sheet transfer during the after-predetermined-time-use condition LL2 under the maximum transfer load MAX in the column LL of FIG. 8B. Reference numeral i–vii are defined in the same way as those in FIG. 9.

In the graphs of the performance characteristic shown in FIGS. 9 and 10, the controller 150 performs the sheet transferring operation under the conditions that the RPM control is performed on and after the second recording sheet 2 since there is no data with respect to the linear speed of the previous recording sheet 2 and therefore the first recording sheet 2 is transferred without the RPM control.

In FIGS. 9 and 10, times $\alpha$, $\beta$, $\gamma$, $\delta$, $\epsilon$, $\zeta$, $\eta$, $\theta$, and $\iota$ are defined with reference to the position A or K as follows:

$\alpha$; a time the first recording sheet 2 is transferred, wherein the leading edge of the first recording sheet 2 is at the initial position A, $\beta$; a time the second recording sheet 2 is transferred, wherein the leading edge of the second recording sheet 2 is at the initial position A, $\gamma$; a time the first recording sheet 2 is transferred, wherein the leading edge of the first recording sheet 2 is at the position K, $\delta$; a time the second recording sheet 2 is transferred with the RPM correction, wherein the leading edge of the second recording sheet 2 is at the position K, $\epsilon$; a time the second recording sheet 2 is transferred without the RPM correction, wherein the leading edge of the second recording sheet 2 is at the position K, $\zeta$; a time the first recording sheet 2 is transferred, wherein the leading edge of the first recording sheet 2 is at the position K, $\eta$; a time the second recording sheet 2 is transferred with the RPM correction, wherein the leading edge of the second recording sheet 2 is at the position K, $\theta$; a time the second recording sheet 2 is transferred without the RPM correction, wherein the leading edge of the second recording sheet 2 is at the position K, and $\iota$; a time the third recording sheet 2 is transferred with the RPM correction, wherein the leading edge of the third recording sheet 2 is at the position K.

Using the above times, the graph of FIG. 9 which is the performance characteristic under the initial condition with the minimum transfer loads indicates the following measurements:

$\gamma-\alpha=1007.7$ ms, without the RPM correction;

$\delta-\beta=976.41$ ms, with the RPM correction;

$\epsilon-\beta=1007.7$ ms, without the RPM correction;

$\eta-\zeta=752.82$ ms (=79.70 cpm), with the RPM correction;

$\theta-\zeta=784.14$ ms (=76.52 cpm), without the RPM correction; and $\iota-\eta=751.56$ ms (=79.83 cpm), with the RPM correction.

From the above measurements, it should be understood that the time period from the time of starting the sheet feed to the time of restarting the sheet feed after the registration by the registration roller 11 is reduced by the RPM correction from 1007.7 ms, which is the case of no RPM correction, to 976.41 ms. Also, it should be understood that the time period between the times of restarting the sheet feed after the registration by the registration roller 11 with respect to the first and second recording sheets 2 is reduced by the RPM correction from 784.14 ms, which is the case of no RPM correction and is equivalent to 76.52 cpm, to 752.82 ms which is equivalent to 79.70 cpm. Also, it should be understood that after the second recording sheet 2 the time period between the times of restarting the sheet feed after the registration by the registration roller 11 with respect to the second and third recording sheets 2, for example, is further reduced by the RPM correction down to 751.56 ms which is equivalent to 79.83 cpm since the linear speed of the second recording sheet 2 has been adjusted by the RPM correction. Therefore, the reduction of the productivity over time due to the increasing transfer loads given to the recording sheet 2 is prevented.

In a similar manner, the graph of FIG. 10 which is the performance characteristic under the after-predetermined-time-use condition with the maximum transfer loads indicates the following measurements:

$\gamma-\alpha$=1048.5 ms, without the RPM correction;

$\delta-\beta$=968.8 ms, with the RPM correction;

$\epsilon-\beta$=1048.5 ms, without the RPM correction;

$\eta-\zeta$=746.39 ms (=80.39 cpm), with the RPM correction;

$\theta-\zeta$=826.09 ms (=72.63 cpm), without the RPM correction; and $\iota-\eta$=744.05 ms (=80.64 cpm), with the RPM correction.

From the above measurements, it is understood that the time period from the time of starting the sheet feed to the time of restarting the sheet feed after the registration by the registration roller 11 is reduced by the RPM correction from 1048.5 ms, which is the case of no RPM correction, to 968.8 ms. Also, it is understood that the time period between the times of restarting the sheet feed after the registration by the registration roller 11 with respect to the first and second recording sheets 2 is reduced by the RPM correction from 826.09 ms, which is the case of no RPM correction and is equivalent to 72.63 cpm, to 746.39 ms which is equivalent to 80.39 cpm. Also, it is understood that after the second recording sheet 2 the time period between the times of restarting the sheet feed after the registration by the registration roller 11 with respect to the second and third recording sheets 2, for example, is further reduced by the RPM correction down to 744.05 ms which is equivalent to 80.64 cpm since the linear speed of the second recording sheet 2 has been adjusted by the RPM correction. Therefore, the reduction of the productivity over time due to the increasing transfer loads given to the recording sheet 2 is prevented.

In the discussion above, the sheet transferring mechanism 106 of the image forming apparatus 100 performs the sheet transfer operation in an ideal manner. However, it is more realistic to take a certain tolerance of the RPM correction into consideration of the sheet transfer operation. The following discussion describes a case in which a correction tolerance of ±5%, for example, is applied.

In this case, the controller 150 performs the RPM control with the correction tolerance of ±5%. In a discussion of this RPM control, the definitions of the RPM R1, the RPM R'1, the actual linear speed V1, the actual linear speed V'1, the outer diameter Df, the outer diameter De, the ideal linear speed V0, the ideal linear speed V'0, the RPM R2, and the RPM R'2 remain same as described above.

Accordingly, in the RPM control for the RPM correction with the correction tolerance of ±5% performed by the controller 150, the RPM R2 and the RPM R'2 are controlled to satisfy the following equations;

$$\{(\pi\times Df\times R1^2)/V1\}\times 0.95\leqq R2\leqq\{(\pi\times Df\times R1^2)/V1\}\times 1.05,$$

and $$\{(\pi\times De\times R'1^2)/V'1\}\times 0.95\leqq R'2\leqq\{(\pi\times De\times R'1^2)/V'1\}\times 1.05.$$

On and after a third recording sheet 2 following the second recording sheet 2, the respective equations can be modified as follows, wherein n is an integer greater than 2;

$$[[\pi\times Df\times\{R(n-1)\}^2]/V(n-1)]\times 0.95\leqq R(n)\leqq[[\pi\times Df\times\{R(n-1)\}^2]/V(n-1)]\times 1.05,$$

and $$[[\pi\times De\times\{R'(n-1)\}^2]/V'(n-1)]\times 0.95\leqq R'(n)\leqq[[\pi\times De\times\{R'(n-1)\}^2]/V'(n-1)]\times 1.05.$$

Further, the above equations can be expressed in the following more generic equation;

$$[[\pi\times D\times\{R(n-1)\}^2]/V(n-1)]\times 0.95\leqq R(n)\leqq[[\pi\times D\times\{R(n-1)\}^2]/V(n-1)]\times 1.05. \quad (2)$$

With the above arrangement, the performance characteristic under the initial condition with the minimum transfer loads, like the one shown in the graph of FIG. 9, would bring the following measurements:

$\gamma-\alpha$=1007.7 ms, without the RPM correction;

$\delta-\beta$=1027.80 ms by the RPM correction of −5%, or 929.91 ms by the ROM correction of +5%;

$\epsilon-\beta$=1007.7 ms, without the RPM correction;

$\eta-\zeta$=792.44 ms (=75.72 cpm) by the RPM correction of −5%, or 716.97 ms (=83.69 cpm) by the RPM correction of +5%;

$\theta-\zeta$=784.14 ms (=76.52 cpm), without the RPM correction; and $\iota-\eta$=791.12 ms (=75.84 cpm) by the RPM correction of −5%, or 715.77 ms (=83.83 cpm) by the RPM correction of +5%.

In a similar manner, the performance characteristic under the after-predetermined-time-use condition with the maximum transfer loads, like the one shown in the graph of FIG. 10, would bring the following measurements:

$\gamma-\alpha$=1048.5 ms, without the RPM correction;

$\delta-\beta$=1019.79 ms by the RPM correction of −5%;

$\epsilon-\beta$=1048.5 ms, without the RPM correction;

$\eta-\zeta$=785.67 ms (=76.37 cpm) by the ROM correction of −5%, or 710.85 ms (=84.41 cpm) by the RPM correction of +5%;

$\theta-\zeta$=826.09 ms (=72.63 cpm), without the RPM correction; and $\iota-\eta$=783.21 ms (=76.61 cpm) by the RPM correction of −5%, or 708.62 ms (=84.67 cpm) by the RPM correction of +5%.

As indicated above, the RPM correction of −5% adjusts the copy speed to a level close to the copy speed in the case of no RPM correction but the RPM correction of +5% greatly increases the copy speed. The tolerance of the RPM correction is usually set to a degree smaller than ±5% but it may be extended to a degree of ±8%, which may be a limit, without causing adverse unexpected side effect.

Figure 11:
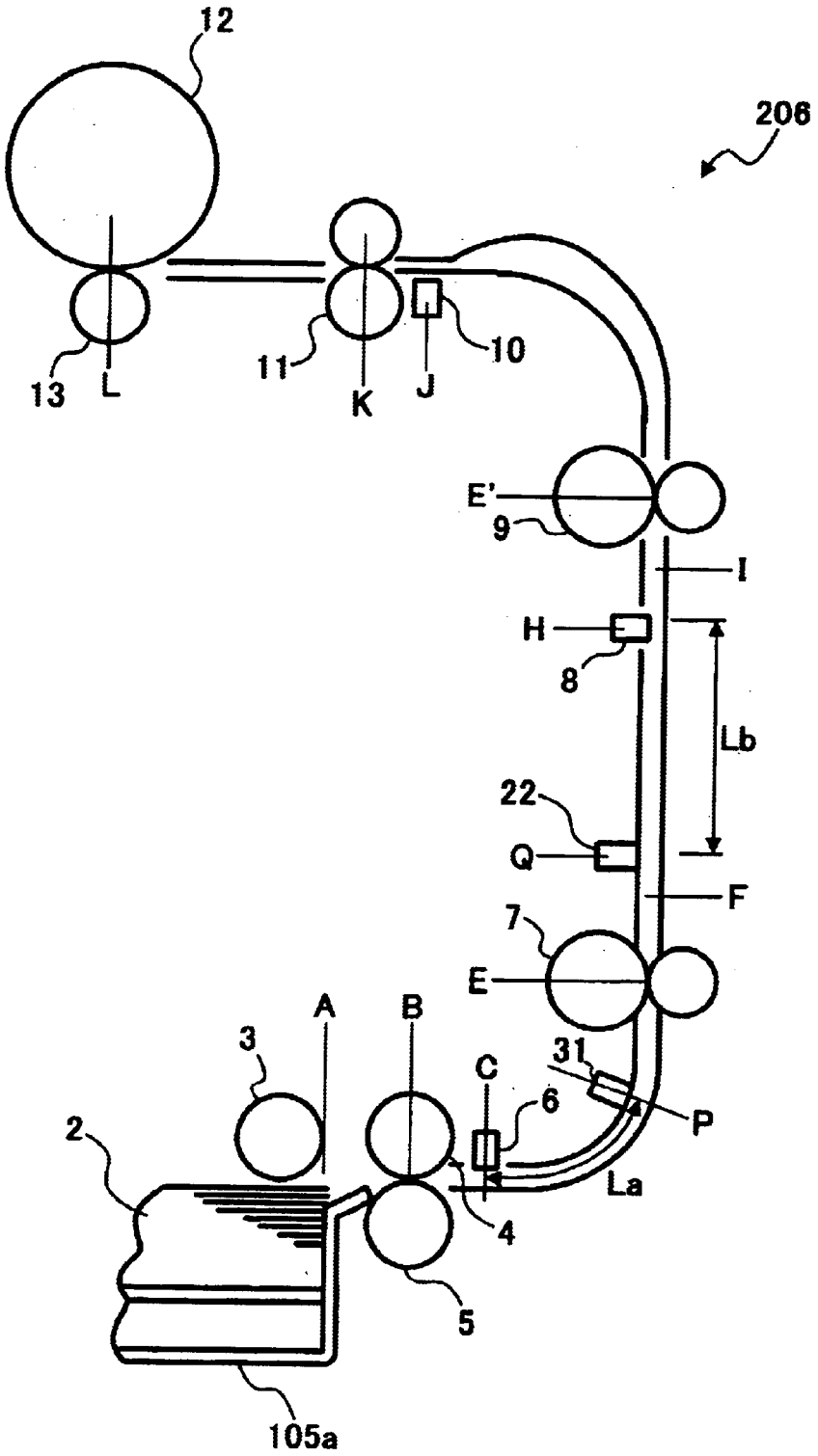
FIG. 11 an illustration of a sheet transferring mechanism according to another embodiment of the present invention.

Next, a sheet transferring mechanism 206 according to another preferred embodiment of the present invention is explained with reference to FIG. 11. FIG. 11 shows the sheet transferring mechanism 206 which is similar to the sheet transferring mechanism 106 of FIG. 6, except for photo sensors 31 and 32 for detecting an existence of the recording sheet 2 at predetermined positions P and Q, respectively, as shown in FIG. 11.

In this example, the linear speed of the feed roller 4 and the transfer roller 7, for example, are measured with the photo sensors substituting the laser Doppler velocity sensors. A method of measuring a speed of a moving sheet with photo sensors is to detect a moving sheet at two different position having a predetermined distance therebetween and to divide the predetermined distance by a time period between the detection at the two different positions. In this example, the photo sensor 31 is provided at the position P which has a distance La downstream from the photo sensor 6 located at the position C in the sheet transferring direction. The distance La is defined as;

$$La=Df\times\pi\times n,$$

wherein n represents a number of revolutions of the transfer roller and is set to 1 in this example, and Df represents the outer diameter of the feed roller 4. Accordingly, the distance La is equivalent to a perimeter of the feed roller 4. That is, the position P is made equal to the position D of the sheet transferring mechanism 106, for the sake of simplicity. Thus, the photo sensors 6 and 31 measure a time period in which the recording sheet 2 is transferred from the position C to the position P and based on which the linear speed of the recording sheet 2 between the positions C and P can be calculated. With this arrangement, the linear speed is detected without an adverse affect from variations of the linear speed locally caused due to an unexpected eccentric rotation axis of or an unexpected imprecision cylindrical shape of the feed roller 4.

Likewise, the photo sensor 32 is mounted at the position Q which has a distance Lb upstream from the photo sensor 8 located at the position H in the sheet transferring direction. The distance Lb is defined as;

$$La=De\times\pi\times n,$$

wherein n represents a number of revolutions of the transfer roller and is set to 1 in this example, and De represents the outer diameter of the transfer roller 7. Accordingly, the distance Lb is equivalent to a perimeter of the transfer roller 7. That is, the position Q is made equal to the position G of the sheet transferring mechanism 106, for the sake of simplicity. Thus, the photo sensors 8 and 32 measure a time period in which the recording sheet 2 is transferred from the position Q to the position H and based on which the linear speed of the recording sheet 2 between the positions Q and H can be detected. With this arrangement, the linear speed is detected without an adverse affect from variations of the linear speed locally caused due to an unexpected eccentric rotation axis of or an unexpected imprecision cylindrical shape of the transfer roller 7.

Figure 12:
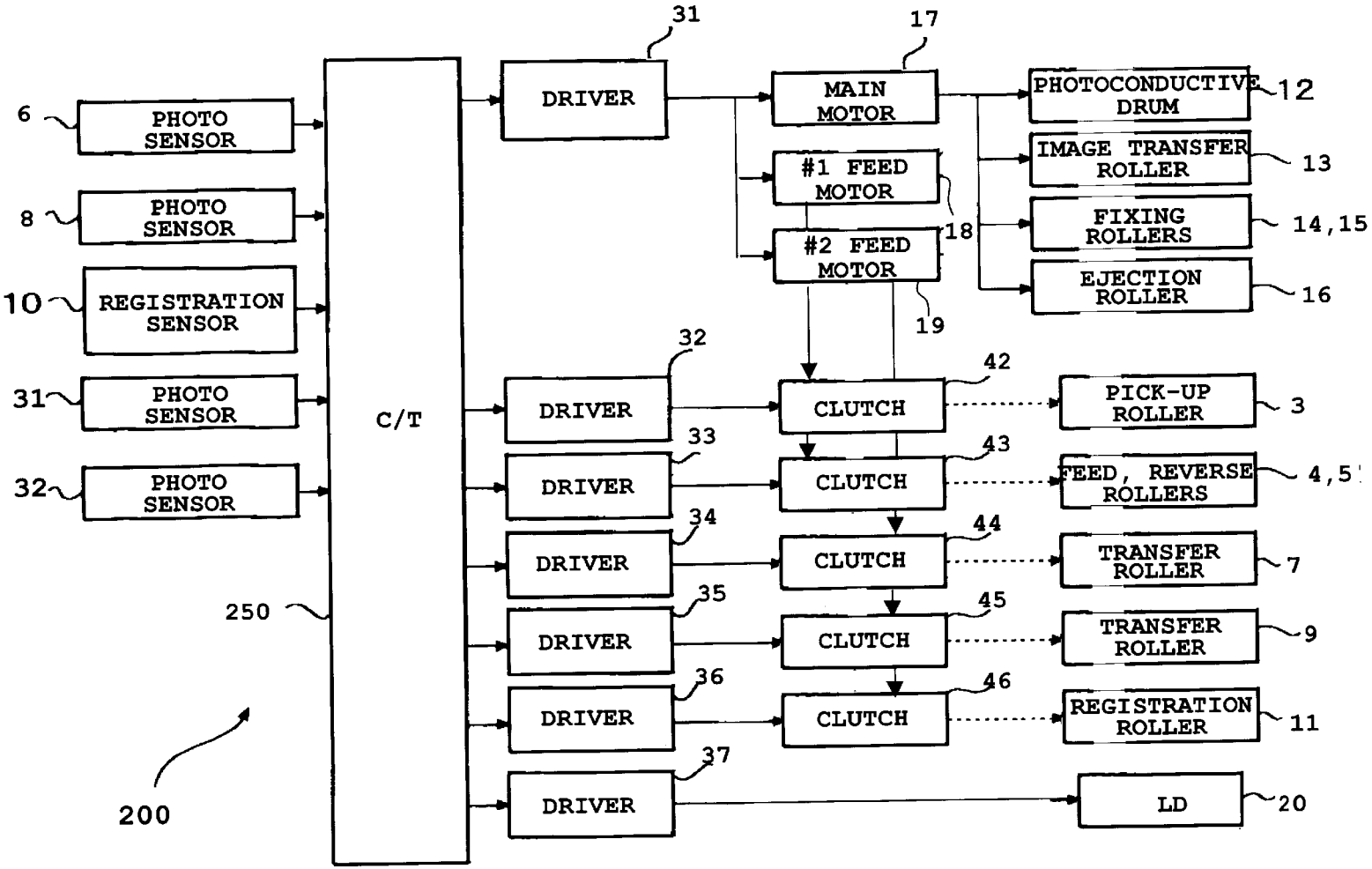
FIG. 12 is a block diagram of an electric system controlling the sheet transferring mechanism of FIG. 11.

This sheet transferring mechanism 206 can be employed in an image forming apparatus (referred to as an image forming apparatus 200) having a structure similar to the above-described image forming apparatus 100. FIG. 12 shows a block diagram of an exemplary electric system of such an image forming apparatus 200. The image forming apparatus 200 includes a controller (referred to as a controller 250) which is similar to the controller 150 of FIG. 7, except for a software stored therein for handling the input signals from the photo sensors 31 and 32. However, since differences between the controller 150 and 250 are simply the software, the details of the controller are not described. In the image forming apparatus 200, an RPM control for controlling the revolutions of the motors is performed with the sheet transferring mechanism 206. The RPM control of this case is explained below.

The linear speed of the recording sheet 2 at the leading edge thereof between the positions C and P is measured with the photo sensors 6 and 31, and the linear speed between the positions Q and H can be obtained with the photo sensors 8 and 32.

In a discussion of this RPM control performed with the sheet transferring mechanism 206, the definitions of the terms remain same as those described in the sheet transferring mechanism 106, including the RPM R1, the RPM R'1, the outer diameter Df, the outer diameter De, the RPM R2, and the RPM R'2. In addition, a measured transfer time period T1 is defined as a time period in which the leading edge of the first recording sheet 2 is moved from the position C to the position P when the first recording sheet 2 is transferred in the sheet passage. A measured transfer time period T'1 is defined as a time period in which the leading edge of the first recording sheet 2 is moved from the position F to the position H when the first recording sheet 2 is transferred in the sheet passage. An ideal transfer time period T0 is defined as a time period in which the leading edge of the recording sheet is moved from the position C to the position P under the conditions that a reduction of the linear speed due to slippage or wear of the rollers is not taken into consideration. The ideal linear speed T0 satisfies an equation;

$$T0=La/(\pi\times Df\times R1).$$

An ideal transfer time period T'0 is defined as a time period in which the leading edge of the recording sheet is moved from the position F to the position H under the conditions that a reduction of the linear speed due to slippage or wear of the rollers is not taken into consideration;

$$V'0=Lb/(\pi\times De\times R'1).$$

With the sheet transferring mechanism 206, the RPM R2 and the RPM R'2 are controlled to satisfy the following equations;

$$R2=(\pi\times Df\times R1^2\times T1)/La=(T1/T0)\times R1,$$

and $$R'2=(\pi\times De\times R'1^2\times T'1)/Lb=(T'1/T'0)\times R'1.$$

Here, since the distances La and Lb are;

$$La=Df\times\pi\times n,$$

and $$Lb=De\times\pi\times n,$$

Wherein n represents a number of revolutions of the transfer roller and is set to 1 in this example, and the RPM R2 and the RPM R'2 are modified as;

$$R2=R1^2\times T1,$$

and $$R'2=R'1^2\times T'1.$$

On and after a third recording sheet 2 following the second recording sheet 2, the RPM of the feed roller 4 and the RPM of the transfer rollers 7 and 9 during a transfer of the nth recording sheet 2 can be expressed as R(n) and R' (n), respectively, and the respective equations can be modified as follows, wherein n is an integer greater than 2;

$$R(n)=\{R(n-1)\}^2\times T(n-1),$$

and $$R'(n)=\{R'(n-1)\}^2\times T'(n-1).$$

That is, a linear speed at which a recording sheet 2 is transferred is defined with a parameter of the linear speed of the previously transferred recording sheet 2 in a continuous sheet transferring mode. Therefore, the above equations can be expressed in the following more generic equation;

$$R(n)=[\pi\times D\times\{R(n-1)\}^2\times T(n-1)]/L, \quad (3)$$

wherein R(n) represents an RPM of the transfer roller when transferring the nth recording sheet 2, D represents an outer diameter of the transfer roller, R(n−1) represents an RPM of the transfer roller during a transfer of the (n−1)th recording sheet 2, T(n−1) represents a transfer time period of the (n−1)th recording sheet 2 being transferred between two predetermined positions, and L represents a distance between the two predetermined positions.

Figure 13:
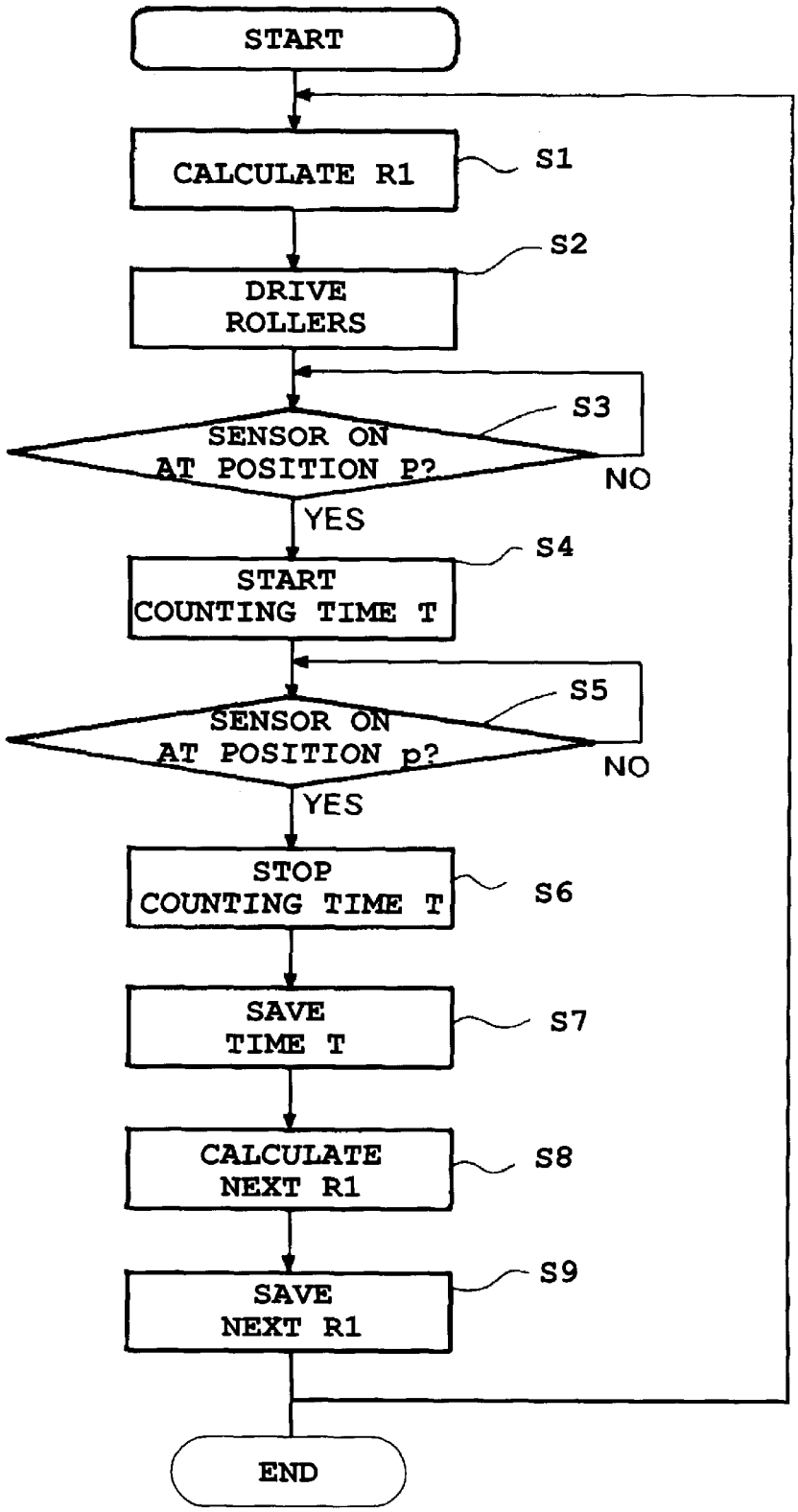
FIG. 13 is a flowchart of the sheet transferring operation performed by the sheet transferring mechanism of FIG. 11.

This RPM control is performed along a procedure shown in FIG. 13. When the sheet transfer operation is started, the controller 250 starts to drive the first motor 18 and calculates the RPM R1 of the feed roller 4 based on the rpm of the first motor 18, in Step S1. The controller 250 then drives the feed roller 4, in Step S2. In this step, the controller 250 drives the feed roller 4 at an RPM calculated on a basis of a measured transfer time period of the immediately previous recording sheet 2. If there is no transfer operation of the immediately previous recording sheet 2, the controller 250 drives the feed roller 4 at a predetermined RPM.

In Step S3, the controller 250 determines whether the leading edge of the recording sheet 2 reaches the position C. This step continues until leading edge of the recording sheet 2 reaches the position C. When the leading edge of the recording sheet 2 is determined as reaching the position C and the determination result of Step S3 is YES, the controller 250 starts counting a time T in Step S4. In Step S5, the controller 250 determines whether the leading edge of the recording sheet 2 reaches the position P. This step continues until leading edge of the recording sheet 2 reaches the position P. When the leading edge of the recording sheet 2 is determined as reaching the position P and the determination result of Step S5 is YES, the controller 250 stops counting the time T in Step S6. Then, the controller 250 saves the time T in the RAM, in Step S7, and calculates the next RPM R1 of the feed roller 4, in Step S8. After that, in Step S9, the controller 250 stores the next RPM R1 calculated in Step S8 into the RAM so as to use it in the transfer of the following recording sheet 2. This procedure then ends.

This procedure is also performed for the RPM R'1 of the transfer rollers 7 and 9 using the photo sensors 32 and 8.

FIGS. 14A and 14B show various data associated with the performance of the sheet transferring mechanism 206 that has the sheet transfer linear speed of 400 mm/s. The columns of FIGS. 14A and 14B are similar to those of FIGS. 8A and 8B, except for the positions P and Q in the column AA, which correspond, as described above, to the positions D and G in the column AA of FIGS. 8A and 8B.

The image forming apparatus 200 employing the sheet transferring mechanism 206 can perform the sheet transferring operation with the RPM control in a manner similar to the performance of the image forming apparatus 100 having the sheet transferring mechanism 106.

The equation (3) can be modified by an application of a correction tolerance of ±5%, for example, and is;

$$[[\pi\times D\times\{R(n-1)\}^2\times T(n-1)]/L]\times 0.95\leqq R(n)\leqq[[\pi\times D\times\{R(n-1)\}^2\times T(n-1)]/L]\times 1.05. \quad (4)$$

As in the case of the sheet transferring mechanism 106, the sheet transferring mechanism 206 can obtain results that the RPM correction of −5% adjusts the copy speed to a level close to the copy speed in the case of no RPM correction but that the RPM correction of +5% greatly increases the copy speed. The tolerance of the RPM correction is usually set to a degree smaller than ±5% but it may be extended to a degree of ±8%, which may be a limit, without causing adverse unexpected side effect.

In addition, another method alternative to the equation (1) applied to the image forming apparatus 100 is explained. As set forth, the image forming apparatus 100 controls the revolutions of the motors with the equation (1) to control the revolutions of the feed and transfer rollers. The alternative method being explained controls a transfer speed at which the recording sheet 2 is moved, and this alternative method is expressed in the following equation;

$$VR(n)=\{VR(n-1)\}^2/V(n-1), \quad (5)$$

wherein VR(n) represents a linear speed of the transfer roller when transferring the nth recording sheet 2, VR(n−1) represents a linear speed of the transfer roller during a transfer of the (n−1)th recording sheet 2, and V(n−1) represents a moving speed of the (n−1)th recording sheet 2.

With the above method, the sheet transferring mechanism 106 can achieve the performance in a manner similar to the case using on the equation (1).

The above equation (5) is obtained in the following way. That is, in this method, the moving speed Vn is an actual moving speed of the recording sheet, and a transfer delay ξ of the recording sheet 2 can be expressed by a ratio V/VR. For the first recording sheet 2, the roller linear speed VRn is expressed as VR1=V0 and the delay ξ is expressed as ξ1=V1/VR1. In this case, V0 means no data and a predetermined value should be given to V0. For the second recording sheet 2, the roller linear speed VRn is expressed as VR2=VR1/ξ1=(VR1)$^2$/V1, and the delay ξ is expressed as ξ2=V2/VR2. For the third recording sheet 2, the roller linear speed VRn is expressed as VR3=VR2/ξ2=(VR2)$^2$/V2, and the delay ξ is expressed as ξ3=V3/VR3. Thus, for the nth recording sheet 2, the roller linear speed VRn is expressed as VRn=VR(n−1)/ξ(n−1)={VR(n−1)}$^2$/V(n−1), and the delay ξ is expressed as ξn=Vn/VRn.

The equation (5) can be modified by an application of a correction tolerance of ±5%, for example, and is;

$$[\{VR(n-1)\}^2/V(n-1)]\times 0.95\leqq R(n)\leqq[\{VR(n-1)\}^2/V(n-1)]\times 1.05. \quad (6)$$

The tolerance of the RPM correction is usually set to a degree smaller than ±5% but it may be extended to a degree of ±8%, which may be a limit, without causing adverse unexpected side effect.

Further, another method alternative to the equation (3) which is applied to the image forming apparatus 200 is explained. As set forth, the image forming apparatus 200 controls the revolutions of the motors with the equation (3) to control the revolutions of the feed and transfer rollers. The alternative method being explained controls a transfer speed at which the recording sheet 2 is moved, and this alternative method is expressed in the following equation;

$$VR(n)=[\{VR(n-1)\}^2\times T(n-1)]/L, \quad (7)$$

wherein VR(n) represents a linear speed of the transfer roller when transferring the nth recording sheet 2, VR(n−1) represents a linear speed of the transfer roller during a transfer of the (n−1)th recording sheet 2, and T(n−1) represents a time period in which the (n−1)th recording sheet 2 is moved a predetermined distance.

With the above method, the sheet transferring mechanism 206 can achieve the performance in a manner similar to the case using the equation (3).

The equation (7) can be modified by an application of a correction tolerance of ±5%, for example, and is;

$$[[\{VR(n-1)\}^2\times T(n-1)]/L]\times 0.95\leqq R(n)\leqq[[\{VR(n-1)\}^2\times T(n-1)]/L]\times 1.05. \quad (8)$$

The tolerance of the RPM correction is usually set to a degree smaller than ±5% but it may be extended to a degree of ±8%, which may be a limit, without causing adverse unexpected side effect.

Figure 15:
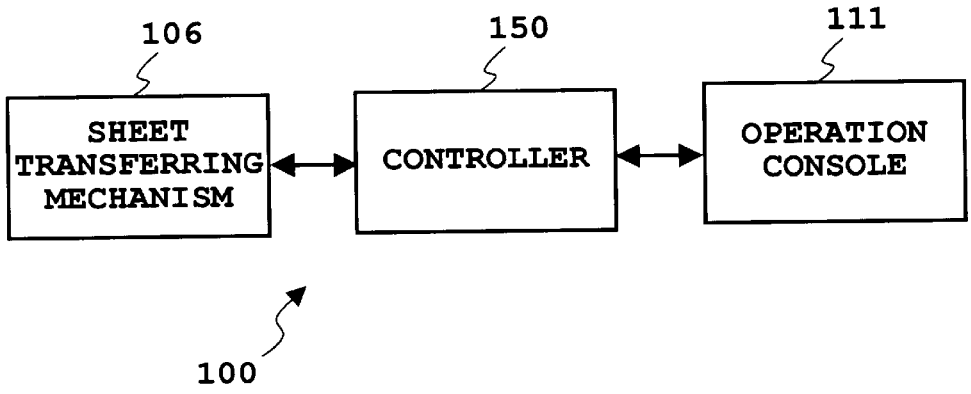
FIGS. 15 and 16 are block diagrams of exemplary warning systems of the sheet transferring operation.

Referring to FIG. 15, an exemplary warning system of the sheet transferring operation provided in the image forming apparatus 100 of FIG. 5 is explained. As shown in FIG. 15, the warning system of the sheet transferring operation is composed of the sheet transferring mechanism 106, the controller 150, and the operation console 111. In the warning system of the sheet transferring operation, the controller 150 detects an event that the transfer speed is varied out of predetermined limits, due to slippage of and wear of the transfer rollers 7 and 9, for example, based on the feedback signals from the sheet transferring mechanism 106. In response to this detection, the controller 150 sends a warning signal to the operation console 111 so that the operation console 111 indicates through the display thereof a warning that the sheet transfer mechanism 106 is in a condition asking for an inspection.

Figure 16:
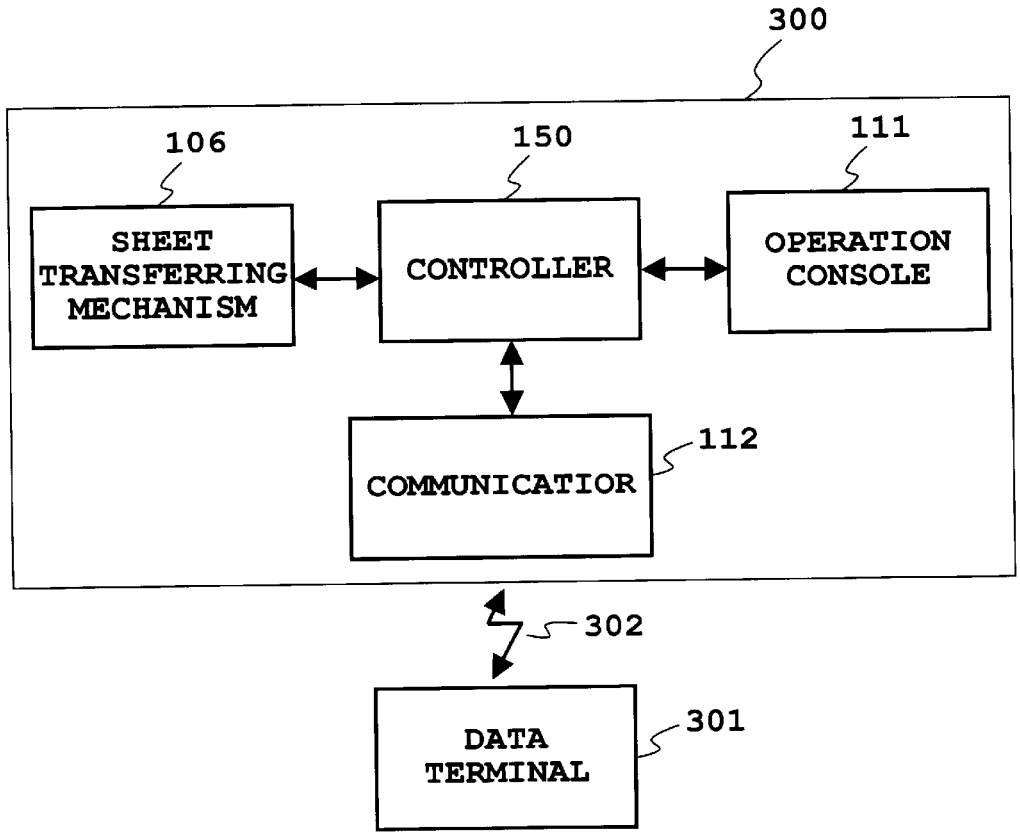

Another exemplary warning system of the sheet transferring operation is explained with reference to FIG. 16. As shown in FIG. 16, an image forming apparatus 300 that includes all the components of the image forming apparatus 100 and additionally includes a communicator 112 for performing communications with an external system, i.e., a data terminal 301, located at a service maintenance company, for example. The image forming apparatus 300 is provided with a warning system of the sheet transferring operation which is composed of the sheet transferring mechanism 106, the controller 150, the operation console 111, and the communicator 112. In the warning system of the sheet transferring operation, the controller 150 detects an event that the transfer speed is varied out of predetermined limits, due to slippage of and wear of the transfer rollers 7 and 9, for example, based on the feedback signals sent from the sheet transferring mechanism 106. In response to this detection, the controller 150 sends a request signal for requesting a maintenance service to the external data terminal 301 via a communications line, such as a public switched telephone line, the Internet, a private telephone line, a mobile telephone, a private handy-phone system, or the like. At the same time, the controller 150 sends a status signal to the operation console 111 which then indicates through the display thereof a machine status that the sheet transfer mechanism 106 is in a condition asking for an inspection.

Numerous additional modifications and variations are possible in light of the above teachings. It is therefore to be understood that within the scope of the appended claims, the disclosure of this patent specification may be practiced otherwise than as specifically described herein.

This paten specification is based on Japanese patent applications, No. JPAP2001-081211 filed on Mar. 21, 2001 and No. 2002-60796 filed on Mar. 6, 2002, in the Japanese Patent Office, the entire contents of which are incorporated by reference herein.

What is claimed is:

1. A sheet transfer apparatus for use in an image forming apparatus, said sheet transfer apparatus comprising:

a sheet transferring mechanism configured to transfer a recording sheet at a transfer speed to an image forming mechanism in said image forming apparatus; and a controller configured to determine said transfer speed based on a transfer speed used for an immediately previous recording sheet.

2. The sheet transfer apparatus as defined in claim 1, wherein said sheet transferring mechanism comprises:

a transfer roller; and at least two sensors mounted with a predetermined distance from each other and configured to detect a recording sheet being transferred.

3. The sheet transfer apparatus as defined in claim 2, wherein said controller determines said transfer speed using a transfer speed equation:

$$VR(n)=\{VR(n-1)\}^2/V(n-1),$$

wherein n is an integer greater than 1, VR(n) represents a linear speed of the transfer roller when transferring an nth recording sheet, VR(n−1) represents a linear speed of the transfer roller during a transfer of an (n−1)th recording sheet, and V(n−1) represents a moving speed of the (n−1)th recording sheet, and wherein when the n is equal to 1 the linear speed VR(1) is set to a predetermined value.

4. The sheet transfer apparatus as defined in claim 3, wherein said controller applies a correction tolerance of ±5% to the transfer speed equation so that the transfer roller is driven at the linear speed R(n) within a range of:

$$[\{VR(n-1)\}^2/V(n-1)]\times 0.95\leqq R(n)\leqq[\{VR(n-1)\}^2/V(n-1)]\times 1.05.$$

5. The sheet transfer apparatus as defined in claim 2, wherein said controller determines said transfer speed using a transfer speed equation:

$$VR(n)=[\{VR(n-1)\}^2\times T(n-1)]/L,$$

wherein n is an integer greater than 1, VR(n) represents a linear speed of the transfer roller when transferring an nth recording sheet, VR(n−1) represents a linear speed of the transfer roller during a transfer of an (n−1)th recording sheet, L represents the predetermined distance, and T(n−1) represents a time period in which the (n−1)th recording sheet is moved the predetermined distance, and wherein the n is equal to 1 the linear speed VR(1) is set to a predetermined value.

6. The sheet transfer apparatus as defined in claim 2, wherein said controller determines said transfer speed using a transfer speed equation:

$$R(n)=[\pi\times D\times\{R(n-1)\}^2]/V(n-1), \quad (1)$$

wherein n is an integer greater than 1, R(n) represents an RPM of the transfer roller when transferring an nth recording sheet, D represents an outer diameter of the transfer roller, R(n−1) represents an RPM of the transfer roller during a transfer of an (n−1)th recording sheet, and V(n−1) represents a linear speed of the (n−1)th recording sheet, and wherein the n is equal to 1 the linear speed VR(1) is set to a predetermined value.

7. The sheet transfer apparatus as defined in claim 6, wherein said controller applies a correction tolerance of ±5% to the transfer speed equation so that the transfer roller is driven at the linear speed R(n) within a range of:

$$[[\pi\times D\times\{R(n-1)\}^2]/V(n-1)]\times 0.95\leqq R(n)\leqq[[\pi\times D\times\{R(n-1)\}^2]/V(n-1)]\times 1.05.$$

8. The sheet transfer apparatus as defined in claim 2, wherein said controller determines said transfer speed using a transfer speed equation:

$$R(n)=[\pi\times D\times\{R(n-1)\}^2\times T(n-1)]/L, \quad (3)$$

wherein n is an integer greater than 1, R(n) represents an RPM of the transfer roller when transferring an nth recording sheet, D represents an outer diameter of the transfer roller, R(n−1) represents an RPM of the transfer roller during a transfer of an (n−1)th recording sheet, L represents the predetermined distance, and T(n−1) represents a transfer time period of the (n−1)th recording sheet being moved the predetermined distance, and wherein the n is equal to 1 the linear speed VR(1) is set to a predetermined value.

9. The sheet transfer apparatus as defined in claim 8, wherein said controller applies a correction tolerance of ±5% to the transfer speed equation so that the transfer roller is driven at the linear speed R(n) within a range of:

$$[[\pi\times D\times\{R(n-1)\}^2\times T(n-1)]/L]\times 0.95\leqq R(n)\leqq[[\pi\times D\times\{R(n-1)\}^2\times T(n-1)]/L]\times 1.05.$$

10. The sheet transfer apparatus as defined in claim 5, wherein said controller applies a correction tolerance of ±5% to the transfer speed equation so that the transfer roller is driven at the linear speed R(n) within a range of:

$$[[\{VR(n-1)\}^2\times T(n-1)]/L]\times 0.95\leqq R(n)\leqq[[\{VR(n-1)\}^2\times T(n-1)]/L]\times 1.05.$$

11. A sheet transfer apparatus as defined in claim 2, wherein said predetermined distance is defined by an equation:

$$L=D\times\pi\times n,$$

wherein D represents an outer diameter of the transfer roller, π represents a Ludolphian number, and n is an integer.

12. An image forming apparatus, comprising:

an image forming mechanism configured to form a visible image on a recording sheet;

a sheet transferring mechanism configured to transfer the recording sheet at a transfer speed to said image forming mechanism; and a controller configured to determine said transfer speed based on a transfer speed used for an immediately previous recording sheet.

13. The image forming apparatus as defined in claim 12, further comprising:

a display configured to indicate a warning that the sheet transfer mechanism requires an inspection when said transfer speed is varied out of predetermined limits.

14. An image forming system, comprising:

an image forming apparatus, including, an image forming mechanism configured to form a visible image on a recording sheet, a sheet transferring mechanism configured to transfer the recording sheet at a transfer speed to said image forming mechanism, and a controller to determine said transfer speed based on a transfer speed used for an immediately previous recording sheet; and an operation apparatus including a display configured to indicate a warning that the sheet transfer mechanism requires an inspection in accordance with an instruction from said image forming apparatus when said transfer speed is varied out of predetermined limits.

15. The image forming system as defined in claim 14, further comprising:

a communications mechanism configured to send a warning that the sheet transfer mechanism requires the inspection when said transfer speed is varied out of predetermined limits to a service maintenance group through one of a telephone line, Internet, a mobile communication tool, and a personal handy-phone system.

16. An image forming apparatus, comprising:

an image forming mechanism configured to form a visible image on a recording sheet;

a sheet transferring mechanism configured to transfer the recording sheet at a transfer speed to said image forming mechanism; and a controller configured to control a number of revolutions of a motor for driving the transfer roller to determine said transfer speed based on a transfer speed used for an immediately previous recording sheet.

17. An image forming apparatus as defined in claim 16, further comprising:

a display configured to indicate a warning that the sheet transfer mechanism requires an inspection when said number of revolutions of the motor is varied out of predetermined limits.

18. An image forming system, comprising:

an image forming apparatus, including, an image forming mechanism configured to form a visible image on a recording sheet, a sheet transferring mechanism configured to transfer the recording sheet at a transfer speed to said image forming mechanism, and a controller configured to determine said transfer speed based on a transfer speed used for an immediately previous recording sheet; and an operation apparatus including a display configured to indicate a warning that the sheet transfer mechanism requires an inspection in accordance with an instruction from said image forming apparatus when said number of revolutions of the motor is varied out of predetermined limits.

19. The image forming system as defined in claim 18, further comprising:

a communications mechanism configured to send a warning that the sheet transfer mechanism requires the inspection when said number of revolutions of the motor is varied out of predetermined limits to a service maintenance group through one of a telephone line, Internet, a mobile communication tool, and a personal handy-phone system.

* * * * *